US006459056B1

(12) United States Patent
Graham

(10) Patent No.: US 6,459,056 B1
(45) Date of Patent: Oct. 1, 2002

(54) CLEANING APPARATUS FOR CENTRAL VACUUM SYSTEM

(76) Inventor: Bernard John Graham, 476 Maplewood Street, North Bay, Ontario P1B 9B8 (CA)

( * ) Notice: Subject to any disclaimer, the term of this patent is extended or adjusted under 35 U.S.C. 154(b) by 0 days.

(21) Appl. No.: 09/512,178

(22) Filed: Feb. 24, 2000

Related U.S. Application Data

(60) Provisional application No. 60/123,529, filed on Mar. 5, 1999.

(51) Int. Cl.[7] ..... H01H 3/20; A47L 5/38

(52) U.S. Cl. ..... 200/61.6; 15/314; 439/191

(58) Field of Search ..... 15/301, 310, 314, 15/419, 422; 137/360, 377, 382, 382.5; 200/50.01, 50.002, 50.1, 50.28, 51 R, 51.09, 51.11, 51.13, 61.58 R, 61.6, 61.7, 61.86, 330, 331; 285/7; 439/190, 191, 210, 211

(56) References Cited

U.S. PATENT DOCUMENTS

| | | | | | |
|---|---|---|---|---|---|
| 2,810,028 | A | | 10/1957 | Hopper | 200/61.6 |
| 2,979,755 | A | | 4/1961 | McCaskill | 15/314 |
| 2,984,856 | A | | 5/1961 | Hunt et al. | 15/310 |
| 3,027,587 | A | | 4/1962 | Bierstock | 15/301 |
| 3,027,588 | A | | 4/1962 | Bierstock | 15/301 |
| 3,036,170 | A | * | 5/1962 | Forney | 200/61.6 |
| 3,283,093 | A | * | 11/1966 | Bishop | 200/61.6 |
| 3,353,996 | A | | 11/1967 | Hamrick | 134/21 |
| 3,565,103 | A | * | 2/1971 | Maselek | 137/360 |
| 3,568,240 | A | | 3/1971 | Hamrick | 15/314 |
| 4,336,427 | A | | 6/1982 | Lindsay | 200/61.6 |
| 4,735,579 | A | * | 4/1988 | Muser | 439/191 |
| 4,758,170 | A | * | 7/1988 | Hayden | 439/142 |
| 5,111,841 | A | | 5/1992 | Houston et al. | 137/360 |
| 5,263,502 | A | * | 11/1993 | Dick | 137/360 |
| 5,279,016 | A | | 1/1994 | Klassen | 15/301 |
| 5,349,146 | A | * | 9/1994 | Radabaugh | 200/61.6 |
| 5,408,721 | A | | 4/1995 | Wall et al. | 15/301 |
| 5,504,967 | A | | 4/1996 | Graham | 15/301 |
| 5,578,795 | A | * | 11/1996 | Ward | 174/53 |

FOREIGN PATENT DOCUMENTS

| | | | |
|---|---|---|---|
| CA | 675552 | 12/1963 | |
| CA | 2105554 | 9/1993 | A47L/5/38 |
| CA | 2239535 | 6/1998 | A47L/7/00 |
| CA | 2240150 | 6/1998 | A47L/5/38 |
| EP | 165908 | 12/1985 | A47L/5/38 |
| JP | 2147039 | 6/1990 | A47L/5/38 |

* cited by examiner

*Primary Examiner*—Michael Friedhofer
(74) *Attorney, Agent, or Firm*—Young & Basile, P.C.

(57) ABSTRACT

An inlet and switching apparatus for a central vacuum system includes a base body section with a back wall having an inlet aperture formed therein adapted for connection to a central vacuum source. A cover section is mounted on the base body section and extends over a forward side thereof. The cover section includes a front wall spaced from and opposite the back wall. The two sections together form an inlet housing defining a vacuum inlet chamber and this housing has a lower portion forming a dirt receiving opening that permits dirt to enter the chamber under a vacuum influence. A closure member is pivotably mounted on the body section and there is a mechanism for moving the closure member to open or close the inlet aperture. In a preferred embodiment, rails on the cover section engage two nubs on the closure member whereby sliding movement of the cover section causes the closure member to either close or open the aperture. There is an electrical switch mechanism responsive to the sliding movement of the cover section for actuating the central vacuum source. Preferably, the cover section can be swung upwardly to a position exposing the outlet aperture so that the end of a vacuum hose can be inserted therein.

50 Claims, 21 Drawing Sheets

CLEANING APPARATUS FOR CENTRAL VACUUM SYSTEM

This application is a continuation of application Ser. No. 60/123,529 filed Mar. 5, 1999.

BACKGROUND OF THE INVENTION

This invention relates to air inlets for a central vacuum system within a building.

Central vacuum systems are quite common now in homes and other buildings requiring regular vacuum cleaning. Because it is not necessary to move around a rather heavy vacuum cleaning unit, they are rather convenient to use. It is simply necessary to hook up a long cleaning hose to an inlet structure mounted in a convenient wall location. This inlet structure is connected by a hidden pipe system to the central vacuum source. Another advantage of such a system is that the system can provide a fairly high level of vacuum because a large vacuum creating fan can be employed at the fixed vacuum source.

It is known in the art to have a vacuum operated cleaning apparatus intended for use with a central vacuum system. This apparatus includes an inlet housing having top, bottom and side walls defining a vacuum inlet chamber. The housing includes a front with an elongate horizontally extending, dirt receiving opening and an aperture located in one of the walls other than the bottom wall. The aperture is adapted for connection to a pipe leading to a central vacuum source. The side wall is a curved wall extending from one side of the opening along the back of the housing, and to the opposite side of the opening. There are also means for fixedly mounting the inlet housing in the wall of a building or below a cabinet adjacent the floor. This inlet structure further includes a closure member movable between a first position where the aperture is closed and a second position where the aperture is open.

Although the aforementioned vacuum operated cleaning apparatus has met with significant commercial success, there are a few problems associated with its use and these problems have resulted in some builders who are interested in installing central vacuum systems not using these vacuum inlet devices. One difficulty involves the initial installation of the apparatus in a wooden frame wall. In order to install the device at floor level, it is necessary for the builder or carpenter to cut-away or form a gap in the floor plate of the frame wall structure so that there will be the necessary room for installation of the device. Also, the apparatus is installed at a height in the wall which is quite different from the normal height of a central vacuum outlet which is about one foot above floor level. Accordingly, the pipe arrangement and wall connection for the vacuum operated cleaning inlet is somewhat different than that for a standard central vacuum inlet and requires a greater amount of work and co-ordination by the installer. Also, the known vacuum inlet device is designed primarily for installation at the base of a wall at floor level and it is not designed for installation at other locations where such a device might be useful, for example, on a counter top or on a horizontal surface.

Other recognized problems with the known vacuum inlet devices include the following:

(a) It is generally not possible to alter the height of the inlet to accommodate different floor finishes or the suction characteristics of the inlet device in order to increase or decrease the suction;

(b) It is not possible to connect a standard central vacuum hose to this vacuum inlet device in order to use the device as a central vacuum outlet;

(c) It may be difficult to remove debris or objects that get clogged in the device because of its size, the location of the inlet chamber in the wall cavity, and its location immediately adjacent the floor.

SUMMARY OF THE INVENTION

According to one aspect of the invention, an inlet and switching apparatus for a central vacuum system includes a base body section having a back wall with an inlet aperture formed therein adapted for connection to a central vacuum source and a front body section movably mounted on the base body section and extending over a forward side thereof. This front body section has a front wall and the base body section and the front body section together form a central vacuum inlet structure capable of forming a vertically extending vacuum passageway leading to the inlet aperture. The inlet structure has a bottom portion adapted to form a dirt receiving opening that permits dirt to enter the chamber. The inlet structure further provides a valve structure movable between a first position where a flow of air and debris through said vacuum passageway is prevented and a second position where air and debris can flow through the vacuum passageway and out the outlet aperture under a vacuum influence created by the central vacuum system when the apparatus is operatively connected to the central vacuum system. There is also an electrical switch mechanism responsive to the movement of the front body section for actuating the central vacuum source which is turned on and operating when the front body section is in the ON position. A predetermined movement of the front body section between an OFF position and the ON position causes the valve structure to move between the first position and the second position.

Preferably, there is a closure member pivotably mounted on the base body section and the front body section is slidable on the base body section between the OFF position and the ON position.

According to another aspect of the invention, an inlet and switching device for a central vacuum system comprises a base body section that includes a back wall having an inlet aperture formed therein and adapted for connection to a central vacuum source, and a front body section mounted on the base body section and extending over a forward side thereof. The inlet aperture is adapted for insertion of a central vacuum hose end. The front body section has a front wall and the base body section and the front body section together form a central vacuum inlet structure with a vacuum passageway therein and an end portion forming a dirt receiving opening. The vacuum passageway extends at a substantial angle to a central axis of the inlet aperture and the dirt receiving opening is located away from the inlet aperture. The inlet structure further provides a valve structure movable between a closed position where a flow of air and debris through the vacuum passageway is prevented and an open position where air and debris can flow through the vacuum passageway and out the inlet aperture when vacuum is applied to the inlet aperture. There is also an electrical switch mechanism for turning ON and operating the central vacuum source. The front body section is mounted on the base body section so that the front body section can be moved from an initial position, in which the inlet aperture is covered thereby, to another position so that the inlet aperture is exposed at least sufficiently to permit a user to insert the central vacuum hose end into the inlet aperture.

Preferably an engagement structure is formed on the front body section for engaging a portion of a closure member which acts as the valve structure and a sliding movement of the front body section causes the closure member to be pivoted from the closed position to the open position.

According to a further aspect of the invention, an inlet and switching apparatus for a central vacuum system comprises an inlet housing forming a vacuum inlet chamber having a debris-receiving bottom opening and a back wall with an inlet aperture configured for connection to a suction-providing pipe of the central vacuum system. The inlet housing is configured for mounting to a fixed supporting structure. There is also a valve device movably mounted in or on the inlet housing for selectively opening and closing the inlet aperture to the passage of air therethrough during operation of the central vacuum system. The inlet housing includes a valve operating member for selectively operating the valve device to open and close the inlet aperture. An electrical switch is provided for activating and deactivating a vacuum cleaner motor of the central vacuum system. The apparatus further includes a downwardly extending inlet extension adjustably connected to the inlet housing and forming a passageway for debris to flow upwards into the vacuum inlet chamber through the bottom opening. A debris-receiving opening is provided at a bottom end of the downward extension and is adapted for positioning adjacent a horizontal surface to be swept.

In one preferred embodiment the apparatus includes a support bracket adapted to be mounted vertically or horizontally on the supporting structure which can comprise a wall of a building or a cabinet or counter. This bracket has an opening for receiving a tubular extension of the inlet aperture and fastener holes are formed in both the back wall of the inlet housing and the bracket for rigid attachment of the inlet housing to the bracket.

Further features and advantages will become apparent from the following detailed description taken in conjunction with the drawings.

DETAILED DESCRIPTION OF PREFERRED EMBODIMENTS

Figure 1:
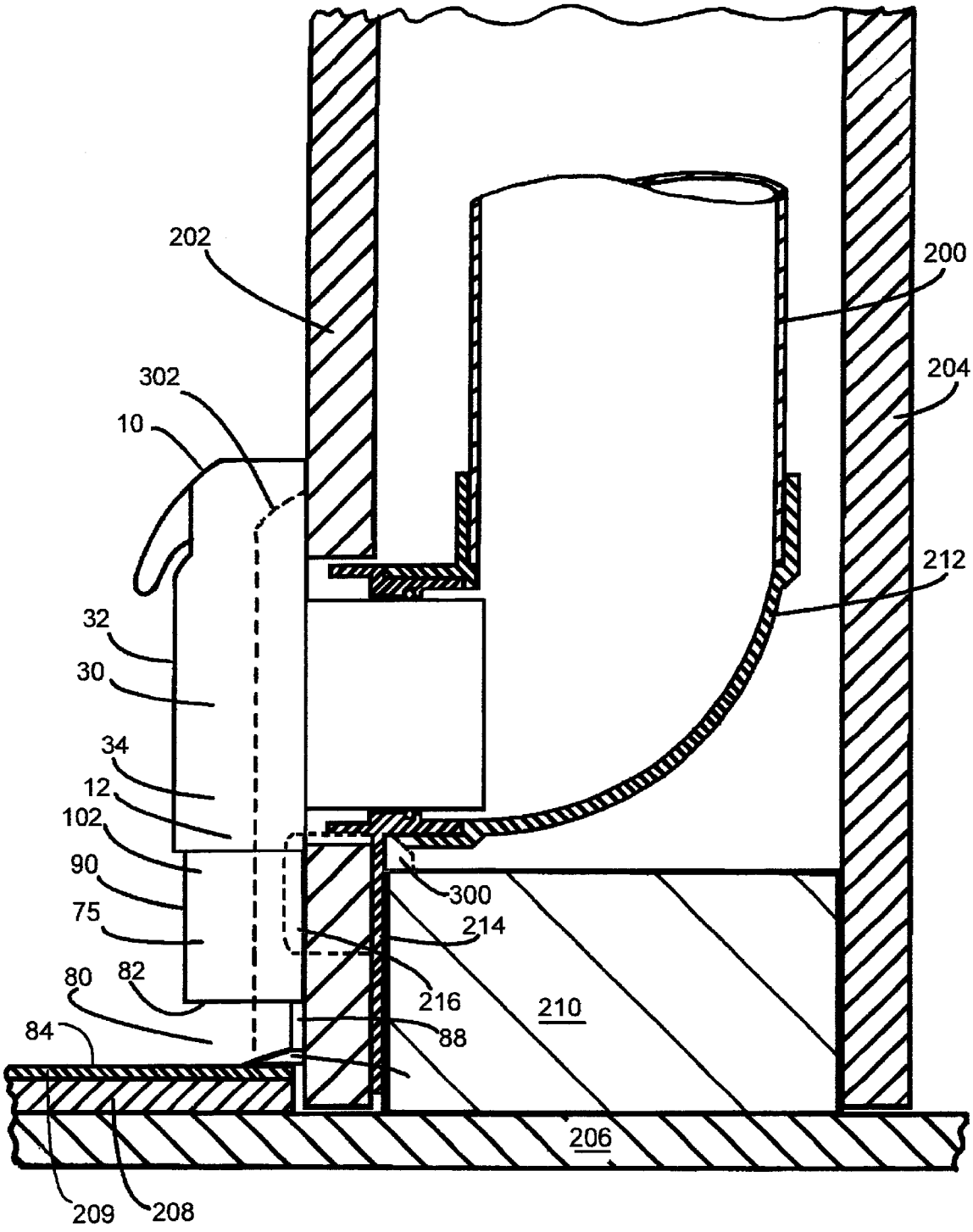
FIG. 1 is a side elevation showing a first embodiment of the combined inlet structure and switching device mounted in a wood frame wall.
Figure 2:
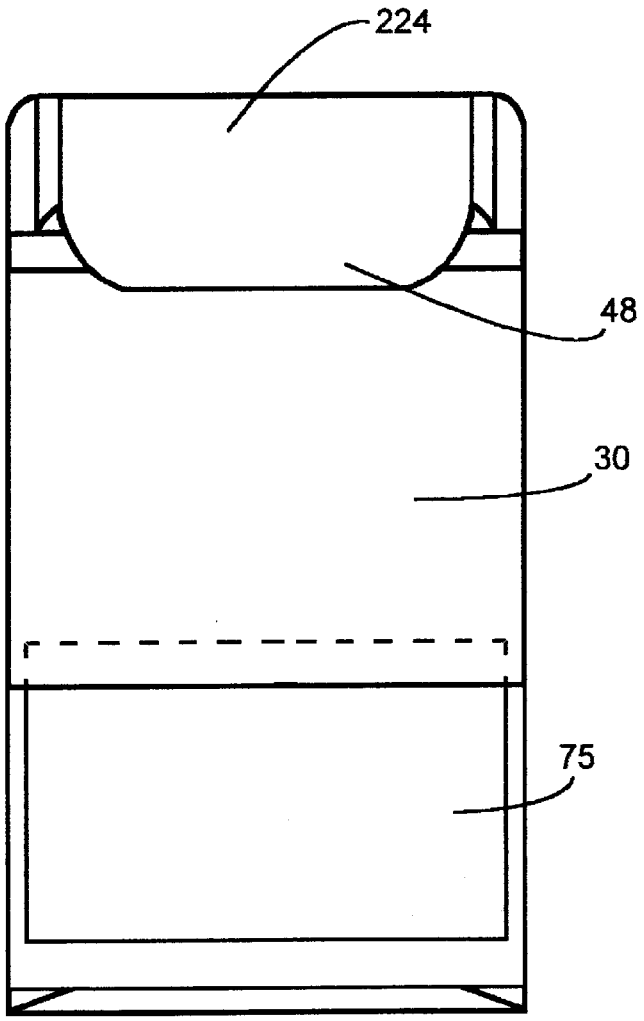
FIG. 2 is a front view of the inlet structure and switching device shown in FIG. 1.
Figure 3:
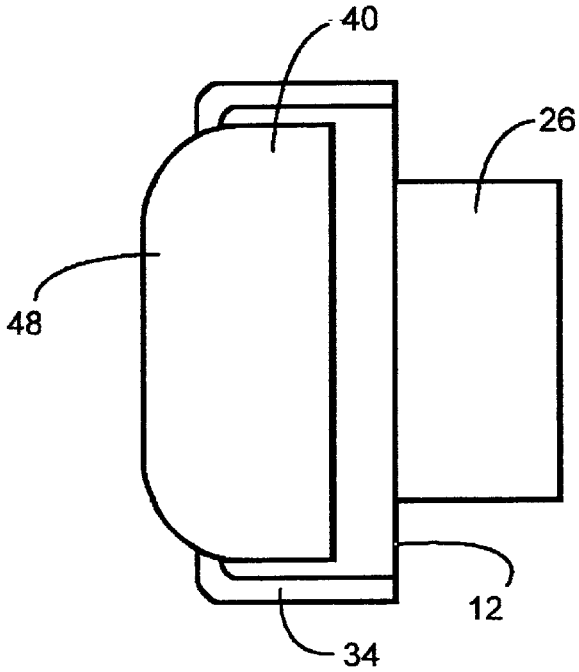
FIG. 3 is a top view of the inlet structure and switching device.

A combined inlet and switching apparatus 10 connected to a vacuum pipe, that is part of a central vacuum system, is shown in FIG. 1. This apparatus includes an inlet housing 12, the details of which are best seen in FIGS. 4, 5, 9 and 10. Also shown in FIG. 1 is a vertically extending vacuum pipe 200 which extends to a central vacuum source (not shown) that can include an electric motor. The vacuum pipe is mounted in a wall which can be made of metal or wood framing. This wall is covered with drywall sheets 202 and 204. The wall extends upwardly from a subfloor 206 which typically is made from ½" plywood. The subfloor may include an additional layer indicated at 208 that can be made from ¼" plywood, this additional subfloor providing a base for a tile surface at 209. The base of the wall is formed by a floor plate 210 typically made of 2×4 frames. It will be noted that with the use of the present inlet apparatus 10, it is not necessary to cut a special gap in the floor plate 210. Connecting the inlet apparatus 10 to the vertical vacuum pipe is a pipe elbow 212 forming a 90 degree turn. The elbow connects to a roughin bracket 214 shown separately in FIGS. 25 to 28. This bracket includes two forwardly extending, parallel flanges 216.

Figure 23:
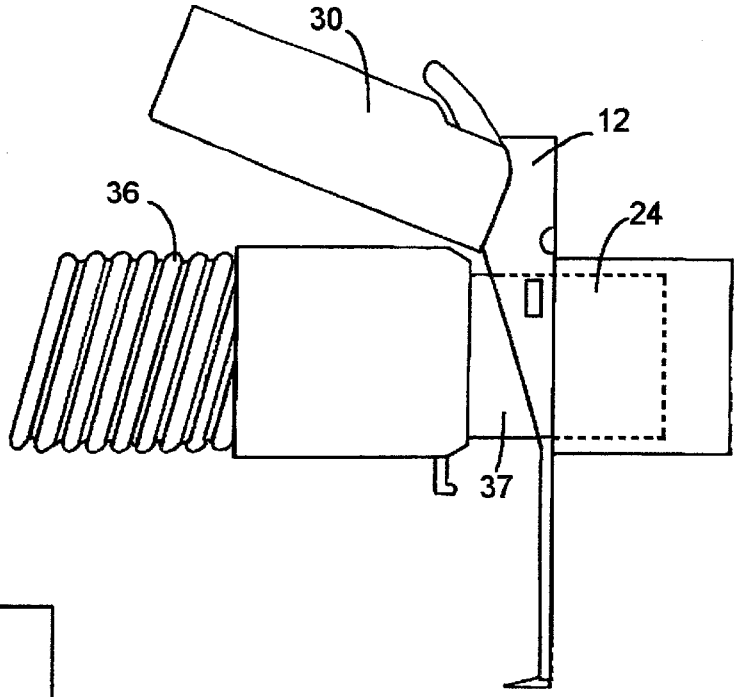
FIG. 23 is a schematic side elevation showing the device of the invention with the front cover pivoted upwardly and a standard central vacuum hose connected thereto.

Turning now to the inlet housing 12 and FIGS. 4, 5, 9 and 10 which illustrates same, this housing has walls which define a vacuum inlet chamber 14. These walls include two, parallel vertical sidewalls 16 and 18, a rear or back wall 20 and a top wall 22. Forming a front section of the inlet housing is a cover section 30 which is pivotably connected to the base body section of the inlet housing and forms a movable front section of the inlet housing. As illustrated, the front cover section includes a generally rectangular front wall or panel 32 and two, parallel side panels 34 integrally connected to the front wall. Projecting pivots 38 extend through the top ends of the sidewalls 16 and 18 and these snap into round recesses formed in the side panels of the cover section. These pivots can be formed with a beveled or sloping end to permit them to be snapped into the recesses in the cover section. In this way the front cover is free to pivot upwardly about the pivots 38 to a position where the front cover projects forwardly from the base body section of the inlet housing (see FIG. 23). Thus the front cover is movable from a closed position where the vacuum inlet chamber 14 is substantially closed at a front side thereof to an open position where the vacuum inlet chamber is open at the front side. As shown in FIG. 23. the capability of the front cover to move to the open position enables one end of a standard central vacuum hose 36 to be operatively connected to the device 10 and this connection of a vacuum hose to the inlet housing will close the electric circuit for operating the central vacuum source in a similar fashion to the manner in which the vacuum hose would close this electric circuit in a standard known central vacuum outlet. The hose has a cylindrical end section 37 which fits snugly into the main section of the inlet housing 12. On the section 37 is an external metal ring (not shown) which closes two electrical contacts mounted in the inlet housing as described below. Formed on the inside of the front cover 30 are two bumps 39 that snap into recesses 41 formed in the sides 16 and 18 of the inlet housing. The bumps 39 help to hold the front cover in the fully closed position.

Figure 14:
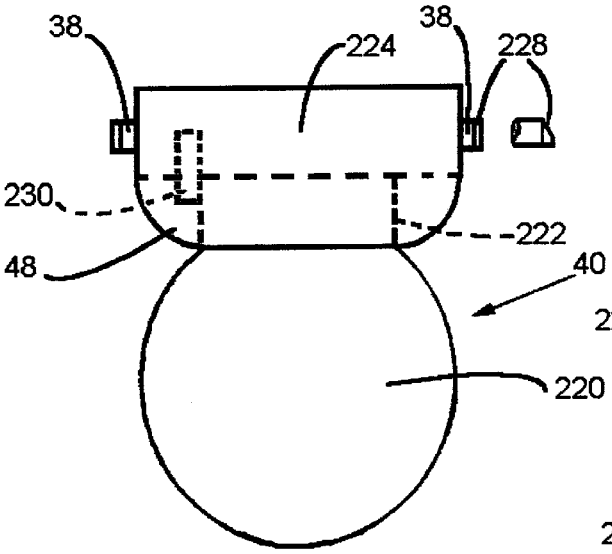
FIG. 14 is a front view of the flap member used in the inlet structure and switching device of the invention.
Figure 15:
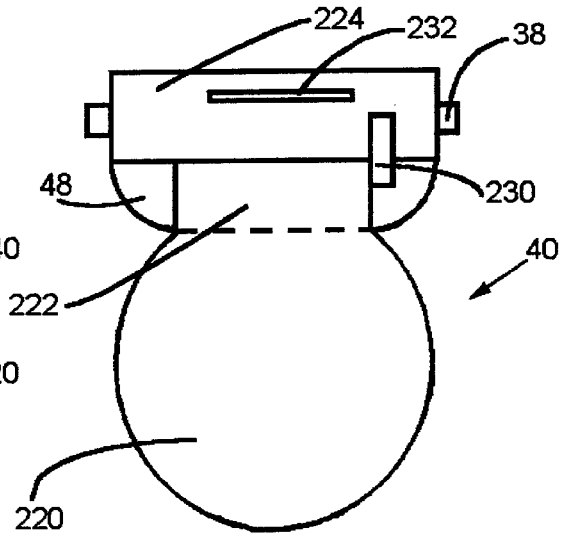
FIG. 15 is a rear view of the flap member.
Figure 16:
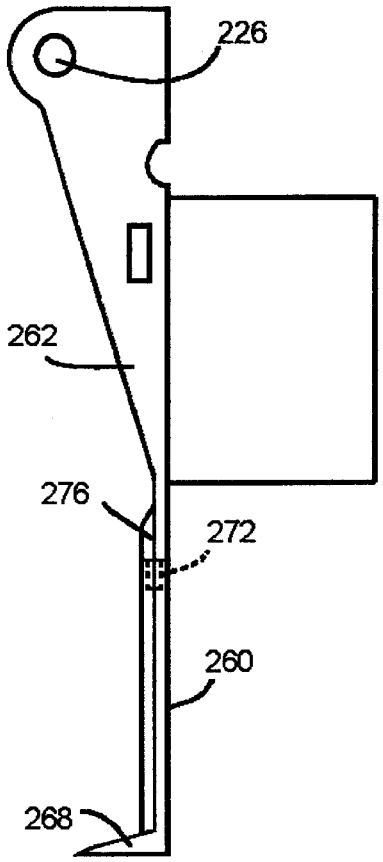
FIG. 16 is a side elevation of a second version of the base body section of the inlet housing with the pivoting cover removed and the flap omitted, this version having a detachable rear extension member.
Figure 17:
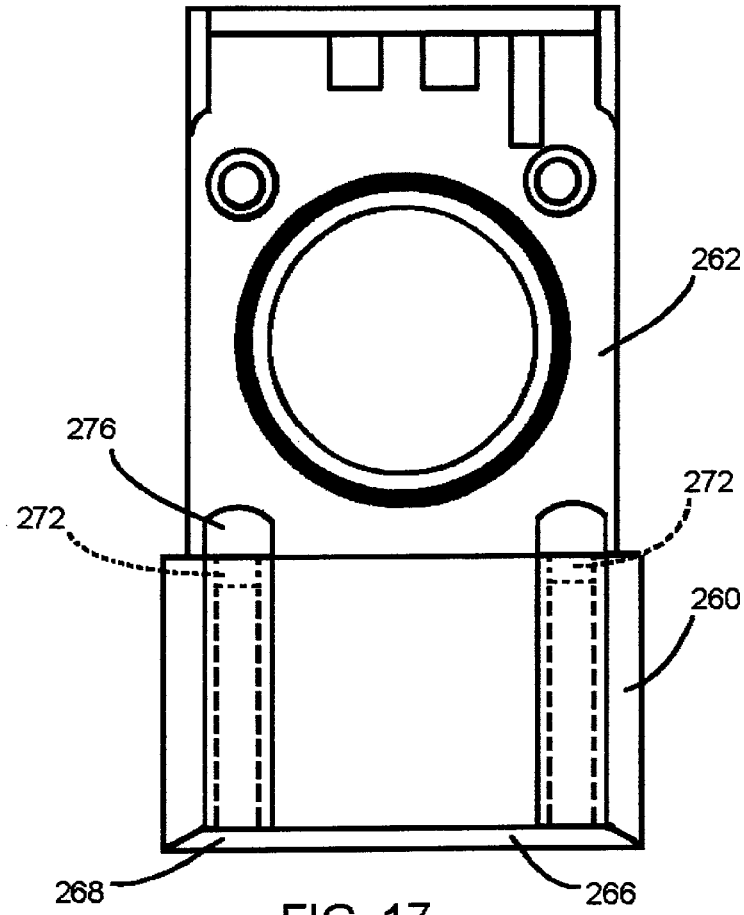
FIG. 17 is a front view of the base body section of the inlet housing of FIG. 16.
Figure 18:
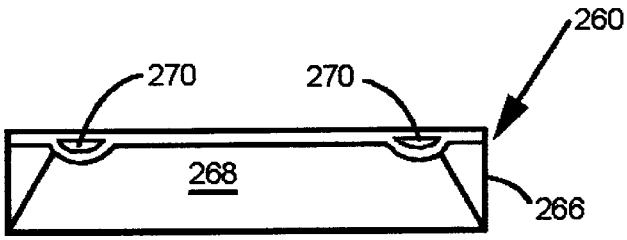
FIG. 18 is a top view of the detachable rear extension member.
Figure 19:
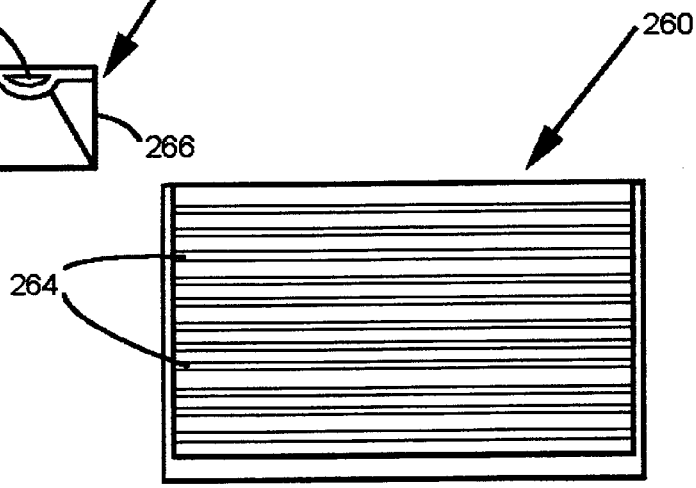
FIG. 19 is a rear view of the detachable extension member.

The inlet apparatus 10 includes a closure member or valve member indicated generally at 40 and shown by itself in FIGS. 14 and 15. The closure member engages a round or oval shaped rubber or rubber-like seal 42 mounted in the base section of the inlet housing 12 at the front end of rearward extension 26. The seal helps prevent a leakage of air around the edges of the closure member when it is in the closed position. The location of the seal can be changed from that shown. For example, it can be mounted on the closure member 40 rather than on the inlet housing. Alternatively, one can provide a seal to seal an opening behind the inlet housing and make the entire inlet housing movable to expose the rear aperture 24 in order to insert the hose. This version could be constructed in several different ways. For example, one could pivotably mount the closure flap on the front wall of the inlet housing adjacent the bottom opening. A suitable seal can then be mounted around the rectangular opening at the front and bottom of the inlet housing. In the alternative, the closure member can be pivotably mounted to a rear wall of the inlet housing and would extend horizontally in the closed position. In the open position, the closure flap would slope downwardly towards the front of the inlet housing. A suitable seal can then extend horizontally around the bottom opening of the inlet housing. It is also possible to mount a vertically movable closure member or housing extension in the bottom opening, this member being open at the front to receive dirt when it is moved to a lowermost, open position. A suitable seal can again be mounted in the bottom of the inlet housing to seal around the closure member when it is moved up to the closed position.

As shown in FIGS. 14 and 15, the preferred closure member has a downwardly extending, substantially circular flap 220. There is a short, straight sided extension 222 which is integrally connected to an upper section which has a rounded portion 224 and a forwardly and downwardly projecting lever or actuator 48. Projecting outwardly from opposite ends of the rounded portion are the two short pivot members 38 which can be beveled at 228 to permit them to be pushed into holes 226 formed to snugly receive same in the main section of the inlet housing. Also projecting downwardly from the rounded portion 224 is a triangular projection 230, the purpose of which is explained below. In addition, a slot 232 is formed in the rounded portion 224. This slot is used to mount a metal inset 234 which can be used to close an electrical circuit as explained below. It will be understood that in order to pivot the closure or valve member 40 between its closed position as shown in FIG. 9 and its open position as shown in FIG. 10, one can manually move the lever or one can move this actuator with one's foot.

Figure 4:
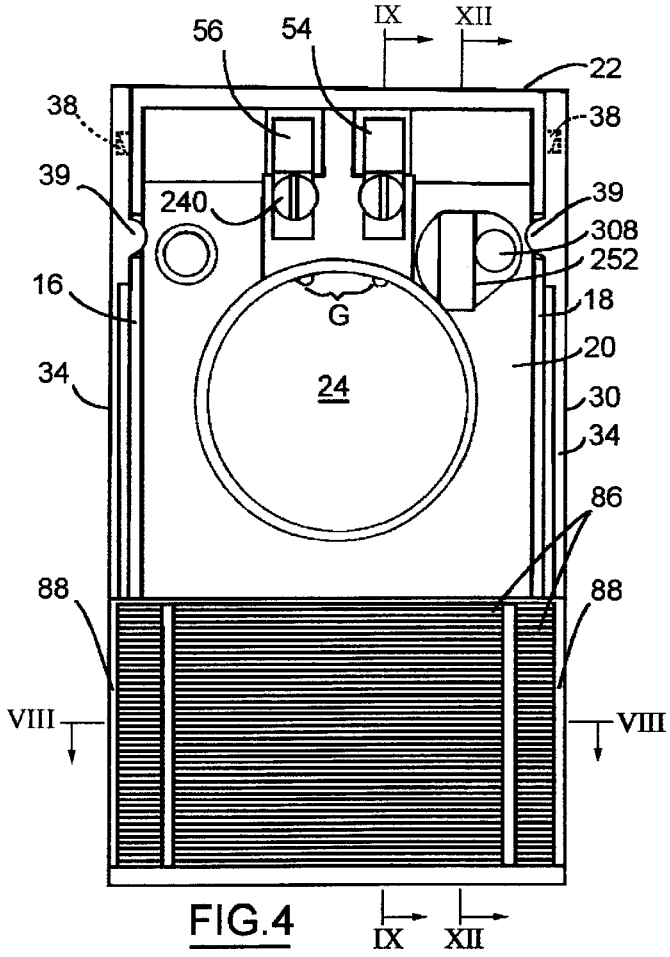
FIG. 4 is a rear view of the inlet housing.
Figure 6:
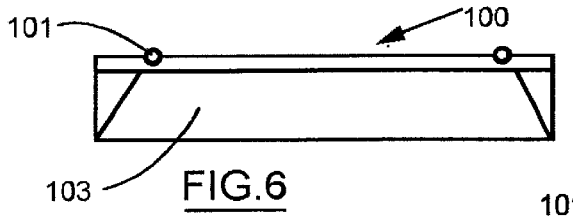
FIG. 6 is a top view of a detachable bottom ramp used with the inlet housing of FIG. 4.
Figure 7:
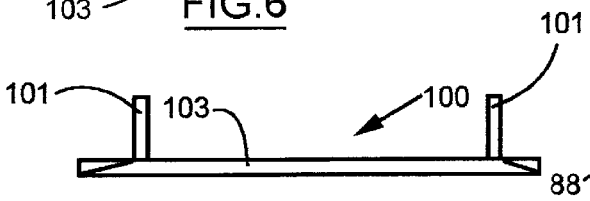
FIG. 7 is a front view of the detachable ramp.

Turning to FIG. 4, there are shown two vertically extending, spring steel contacts 54 and 56 mounted beside each other but spaced apart a short distance. Each contact is securely held in place and held by a screw contact 240 threaded into the back wall. Each spring contact 54, 56 has a forwardly projecting bottom section 242. Each bottom section extends into a slot formed in the wall and each bottom section engages a small metal spring 244 which in turn engages the top of a small brass bullet 246. It will be appreciated that each brass bullet projects through a small hole in the side of the rearward extension 26 and the brass bullet is biased downwardly under the influence of the spring 244. Low voltage electrical wires for the electrical circuit that operates the central vacuum system are connected to each of the contact screws 240. Accordingly when the gap G shown in FIG. 4 is closed by a metal ring member, the electrical circuit for the central vacuum system will be closed and the system will be turned on, generating a vacuum at the inlet apparatus 10. This will occur when the front cover 30 has been moved to the open position shown in FIG. 23 and the end section 37 of the hose inserted into the rear aperture 24.

Figure 9:
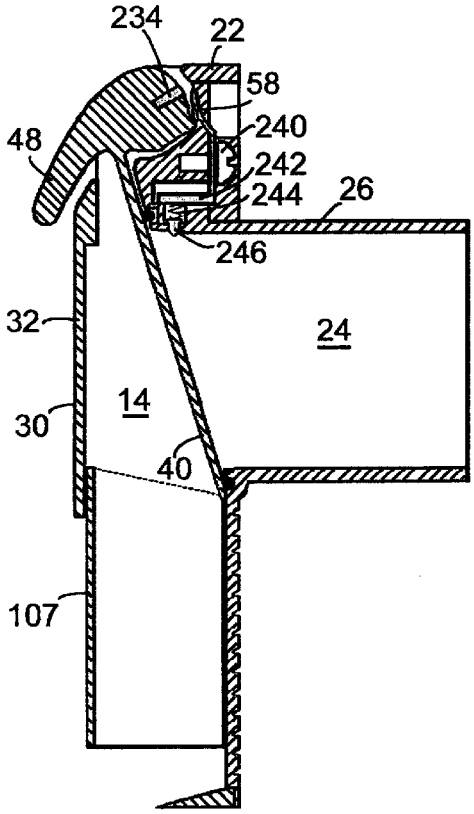
FIG. 9 is a cross sectional elevation of the inlet housing taken along the line IX—IX of FIG. 4, this view showing a closure flap in the closed position.
Figure 10:
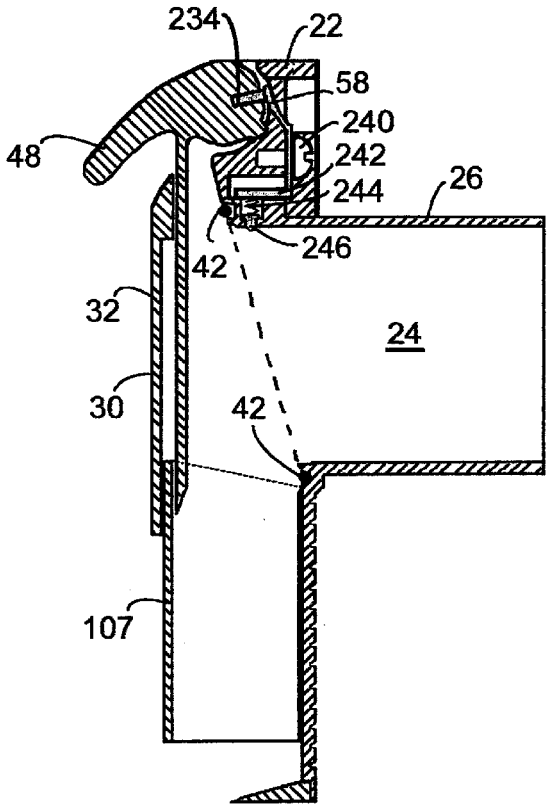
FIG. 10 is another cross-sectional elevation of the inlet housing taken along the line IX—IX but showing the closure flap in the open position.

Each of the spring contacts 54, 56 has a suitably bent upper end section 58 and the gap between the two upper end sections 58 can be closed by the metal insert 234 by pivoting the closure member 40 from the closed position shown in FIG. 9 to the open position shown in FIG. 10 where the metal insert 234 engages the spring contacts 54, 56. Thus when the front cover has not been moved to the open position, simply moving the closure or valve to the open position will close the electrical circuit, causing the central vacuum system to operate. If the user wishes to use the vacuum hose and he or she therefore pivots the front cover from the closed position, this movement will momentarily close the electrical circuit by bringing the metal insert 234 into engagement with the spring contacts 54, 56. However as the front cover is pivoted to the fully open position, the electrical circuit will be opened again and the central vacuum system will not operate until the end of the hose is inserted into the inlet device 10.

Instead of the illustrated closure member 40 and inlet housing 12, one can make the closure member rectangular with two side walls or flanges that extend perpendicular to the front or main wall of the member. The side walls extend back along the sides of the main section of or through slots formed in the housing. When the closure member is pivoted to the open position, the two side walls move away from the main section to form a chamber to direct dirt to the rear aperture 24. Another possible construction for the inlet housing 12 is to provide the base section of this housing with two forwardly projecting sidewalls so that the main section forms three sides of the inlet chamber. The closure member can then be a substantially flat flap member (as in the illustrated version) and when it is moved to the open position, it forms the front of the inlet chamber which again would direct debris and dirt to the rear aperture 24. An adjustable sleeve or housing extension can be provided with either of these alternate constructions and can be similar to the illustrated housing extension 75. This sleeve can provide an inlet passageway downwards to a point close to the surface being swept.

Figure 8:
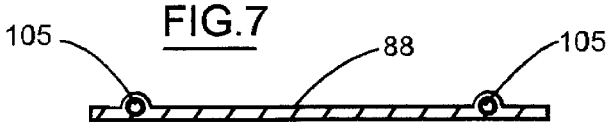
FIG. 8 is a horizontal cross-section of a downwardly extending section of the inlet housing taken along the line VIII—VIII of FIG. 4.
Figure 5:
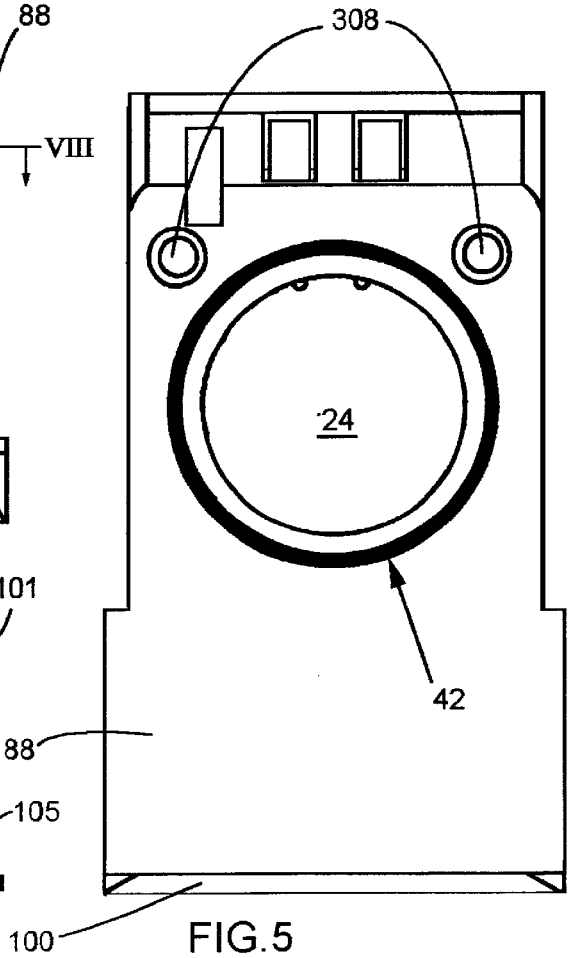
FIG. 5 is a front view of the inlet housing of FIG. 4 with the pivoting front cover removed.

Shown in FIGS. 1, 2 and 4 to 8 is an adjustable inlet extension 75 which is mounted in or at a bottom opening of the inlet housing 12. The preferred inlet extension includes a rear extension section 88 which is an integral extension of the back wall of the inlet housing and a channel shaped front extension member 90. It will be understood that the front and rear sections provide an inlet extension adapted to form a passageway for debris to flow upwards into the vacuum inlet chamber and a debris receiving opening 80 at a bottom end thereof (see FIG. 1). It will be understood that the length of the inlet extension is adjustable so as to provide an upper boundary 82 of the opening 80 that is only about ¼" to ½" above the finished floor level at 84. The length of the downward extension 88 can be readily adjusted by cutting the plastic material from which the downward extension is made. To assist in this cutting process. a number of straight, horizontal cutting grooves 86 can be formed in the rear surface of downward extension 88. Once the extension 88 has been cut to the desired length, a ramp member 100 illustrated separately in FIGS. 6 and 7 can be detachably connected to the extension. The ramp member is formed with two upwardly extending connecting rods 101 located near opposite ends. The ramp member has a generally rectangular main portion which extends horizontally and has a sloping upper surface 103. The rear extension section 88 is formed with vertically extending connecting passageways 105 as illustrated in FIG. 8. It is into these passageways that the connecting pins 101 are inserted. Because the passageways 105 extend at least for most of the height of the section 88. these passageways will be available for insertion of the pins 101 even after the section 88 has been cut to the desired height. The ramp member 100 helps to feed the incoming dirt and debris into the inlet device 10.

The front inlet extension 90 is preferably channel-shaped with two, parallel vertical sidewalls 102, one of which can be seen in FIG. 1. The rear edges of these sidewalls snugly engage the edges of the rear extension. A front wall of member 90 can be seen at 107 in FIG. 9. It will be understood that the cover section 30 is sized and dimensioned internally to snugly receive the front extension 90 both along the front and at the sides and there is frictional engagement between the two members. However with the application of sufficient downward force, the front extension 90 can be moved downwardly from within the front cover 30 to the position shown, for example, in FIG. 1. If one wishes to use the vacuum hose, it is easy to pivot the front cover to the open position shown in FIG. 23.

Figure 12:
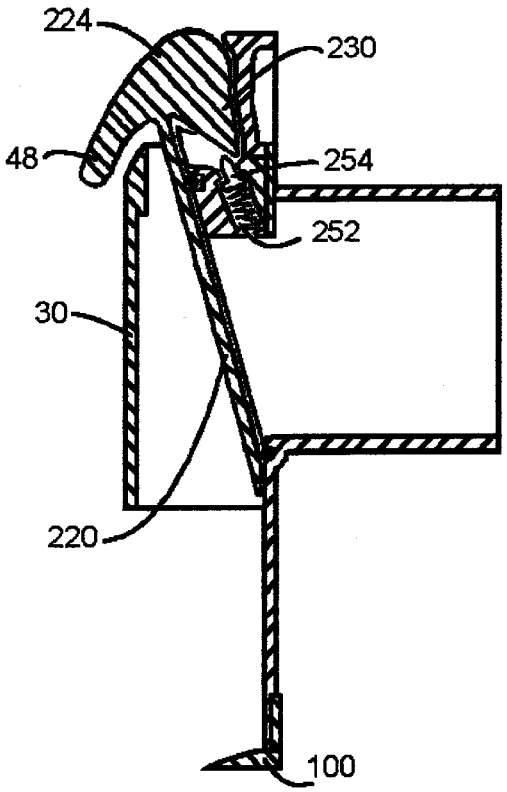
FIG. 12 is a cross-sectional elevation taken along the line XII—XII of FIG. 4, this view showing the flap member in the closed position.
Figure 13:
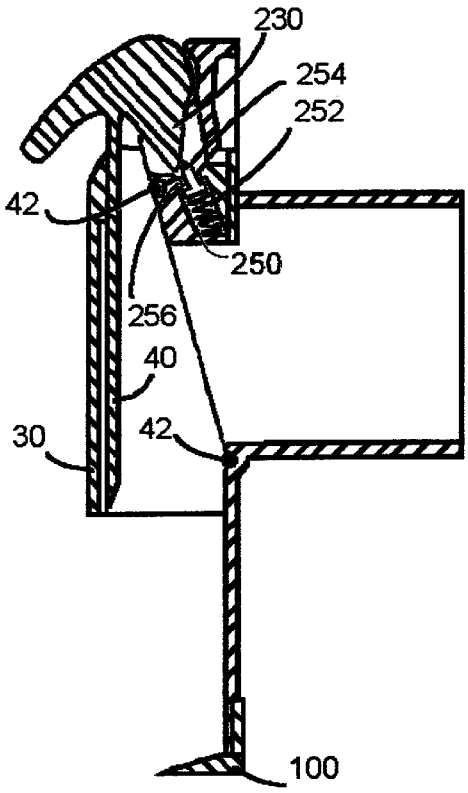
FIG. 13 is a cross-sectional elevation similar to FIG. 12 but showing the flap member in the open position.

Preferably there are means for biasing the closure member 40 either towards its fully closed or towards its open position as selected by movement of the short lever 48. One form of biasing device is illustrated in FIGS. 12 and 13. This biasing device includes small coil spring 250 mounted in the inlet housing 12. The spring is mounted in a small spring chamber 252 formed in the base section of the inlet housing. The bottom end of this chamber is closed while the top end has an opening through which projects a small peg 254 which is biased upwardly by the spring. An inwardly projecting lip or flange 256 is formed at the upper end of the chamber 252 to hold the peg in the chamber. The peg has a sharply tapered upper end which forms a point. This upper end is engaged by the triangular projection 230 formed at the top of the closure member. It will thus be appreciated that by manipulating the lever 48, the user can force the point of the projection 230 past the point of peg 254 in order to move the closure member to the open position shown in FIG. 13. In this position the peg will push upwardly against the projection 230 (under the spring force) and thus hold the closure member 40 in the open position. However when the user wishes to close the closure member and move it to the position in FIG. 12, he or she can simply pull on the lever 48, overcome the spring force, and cause the triangular projection 230 to move pass the peg to the position shown in FIG. 12. Thus in this position, the spring 250 will help to hold the closure member in the closed position. It will be understood to those skilled in the art that instead of the illustrated spring biasing mechanism, it is also possible to employ a spring similar to that shown in U.S. Pat. No. 5,504,967 issued to the present inventor. This spring can be mounted at a suitable location on the inlet housing and could extend vertically at the side of the inlet housing. If desired, such a spring member could also form part of an electrical switch mechanism for the purpose of opening or closing the electrical circuit that operates the central vacuum source.

The lever or actuator for opening or closing the closure member 40 can be made in other ways than that illustrated. For example, the closure member 40 can be biased towards the open position and held in the closed position by a latch device. By depressing or moving the latch manually, the closure member moves to the open position. Alternatively, the closure member 40 can be biased (for example by a spring) to the closed position and held in the open position by a latch. By depressing or moving the latch, the closure member moves to the closed position. A further alternative would be to use a known type of latch mechanism similar to that found on stereo cabinetry. With this version, initial depression of the latch causes the flap to open while a second depression of the latch causes the closure member 40 to be held in the closed position. It will be appreciated that one skilled in this art could conceive of various combinations of springs, latches, electrically operated solenoids and other known mechanisms, made of a variety of materials, in order to open or close the closure member or valve 40.

Shown in FIGS. 16 to 19 is a variation of the base body section of the inlet housing and the rear downward extension. In this embodiment, there is a separate rear extension section indicated at 260. This extension section is detachably connected to the main section of the inlet housing indicated at 262. The rear extension section 260 has a number of horizontally extending grooves 264 formed in the back thereof to permit this section to be cut to the desired length easily. Integrally formed on the bottom of the section 260 is a forwardly projecting ramp section 266 with a sloping upper surface 268. Formed in the section 260 are two vertically extending passageways 270 and these extend most of the height of the section 260. Downwardly projecting from the bottom edge of the base wall are two connecting tabs 272 and these are inserted into upper end portions of the passageways 270 after the extension 260 has been cut to the desired height. Bulging sections 276 can be formed along the bottom of the back wall on the front side, providing additional support for the downward extension.

Figure 11:
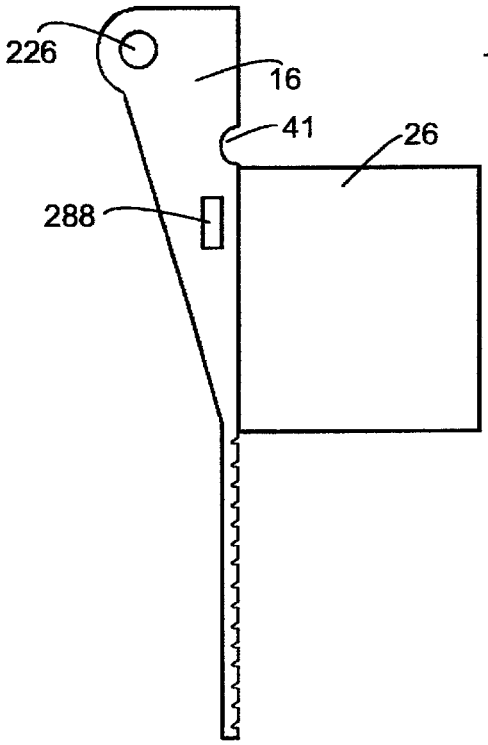
FIG. 11 is a side view of the base body section of the inlet housing with the pivoting front cover removed and the flap member omitted.
Figure 20:
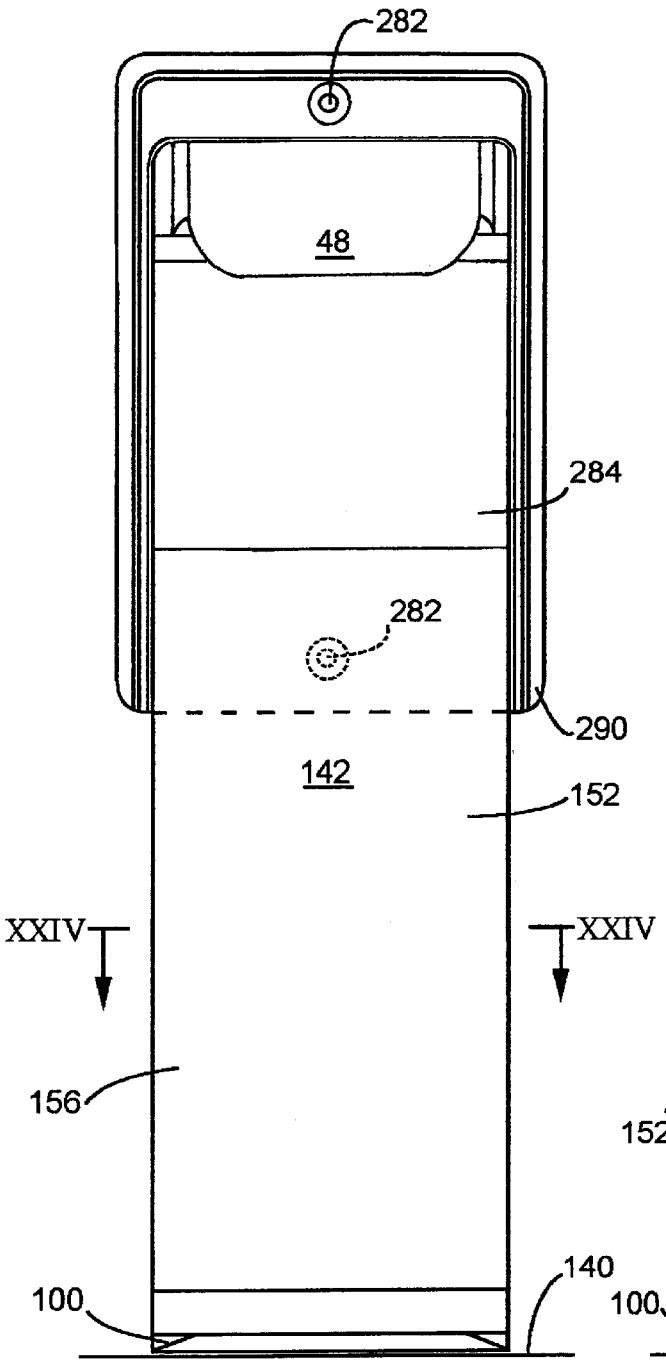
FIG. 20 is a front view of another embodiment of an inlet structure and switching device constructed in accordance with the invention, this embodiment having a long inlet extension projecting downwardly from the main inlet device.
Figure 21:
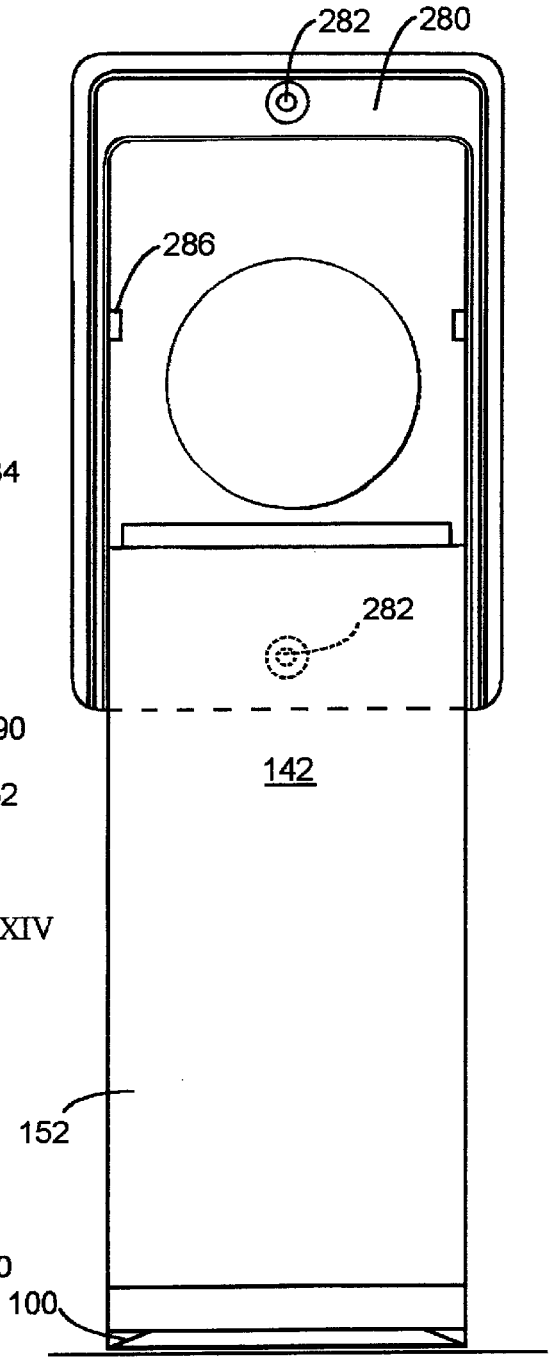
FIG. 21 is another front view of the embodiment of FIG. 20 but with the main inlet device removed and omitted.
Figure 22:
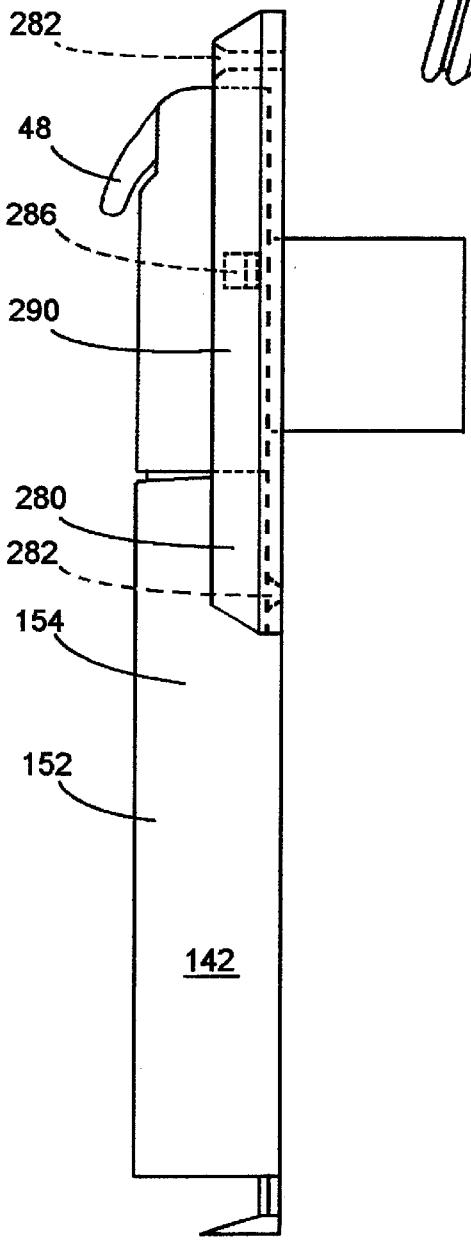
FIG. 22 is a side elevation of the embodiment of FIG. 20.

It is also possible to mount the combined inlet and switching apparatus 10 at a substantially greater height above the floor surface, for example approximately one foot above a floor surface 140 as shown in FIGS. 20 to 22. With this arrangement, a much longer inlet extension 142 is used. With the use of this long inlet extension, it is possible to mount the vacuum inlet structure 10 at the same height, for example, as a standard central vacuum outlet. This can make it easier to reach the lever member 48 with one's hand in order to turn the vacuum inlet apparatus either off or on. The arrangement of FIGS. 20 to 22 is most likely to be used for retrofitting existing homes that already have conventional central vacuum systems. This unit is provided with a long, retrofit mounting plate 280 that can replace the standard vacuum inlet of a central vacuum system. Provided in this plate are screw holes 282 used to attach the plate to a standard mounting bracket for a vacuum outlet. The upper section of this mounting plate forms a recess with an open bottom and into this recess can be inserted the inlet apparatus 10. Two nibs 286 project inwardly into the recess and these are sized and located to snap into rectangular recesses 288 formed in the side of the inlet housing (see FIG. 11). The nibs can be formed with sloping surfaces at the front and rear to permit easy attachment.

Figure 24:
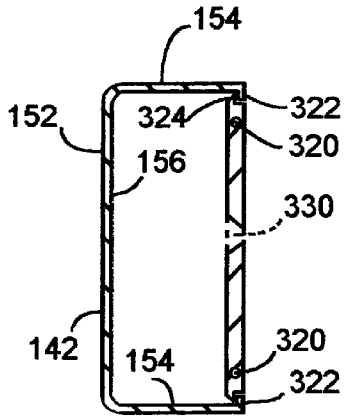
FIG. 24 is a horizontal cross-sectional view taken along the line XXIV—XXIV of FIG. 20.

The inlet extension can be cut to the required length and this includes cutting a channel-shaped front section 152 having two, parallel vertical sidewalls 154 and a connecting rectangular front wall 156. The rear portion of the extension tube must also be cut to the required length and then the ramp member 100 connected thereto. In this version, the inlet extension has a substantial length of at least eight inches in order to permit the inlet housing to be at a height on the building wall that is at least 8 inches above the horizontal surface to be swept. The ramp member for this embodiment can be constructed in the same manner as the embodiment illustrated in FIGS. 6 and 7. In other words the rear portion has two vertically extending passageways 320 to accommodate the pins of the ramp member. As shown in FIG. 22, an upper portion of the front section 152 fits between side flanges 290 of the mounting plate helping to support the front section. Various mechanisms can be used to further connect the front section 152 to the rear section. For example, as shown in FIG. 24, short inwardly projecting edge flanges 322 can be formed on the lower portion of the section 152 and these can fit over vertical edge flanges formed on the rear section. The rear section of the inlet extension can be provided by an integral molded extension of the mounting plate 280 or it can be provided by one or more separate rear clip plates. The integral extension or the separate clip plates can be detachably connected to the wall by suitable screws that extend through screw holes 330, one of which is shown in FIG. 24.

Figure 25:
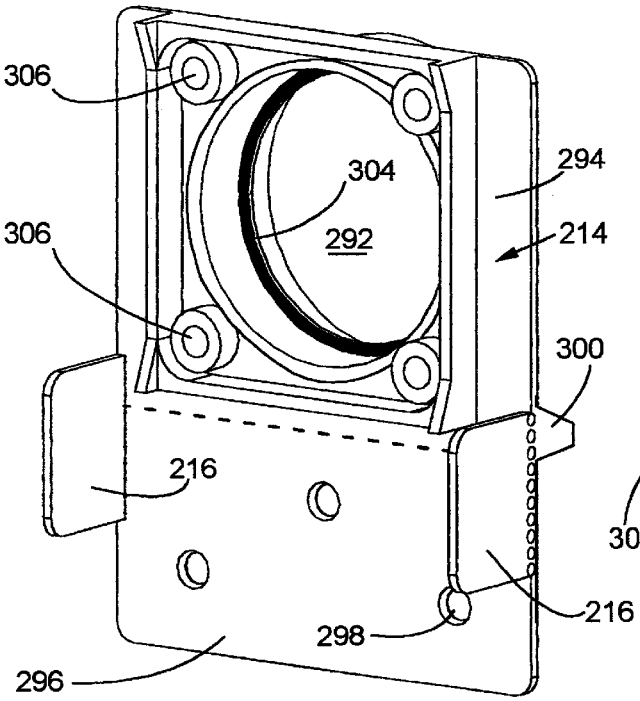
FIG. 25 is a perspective view showing the front and right side of a rough-in bracket usable with the inlet and switching device of the invention.
Figure 26:
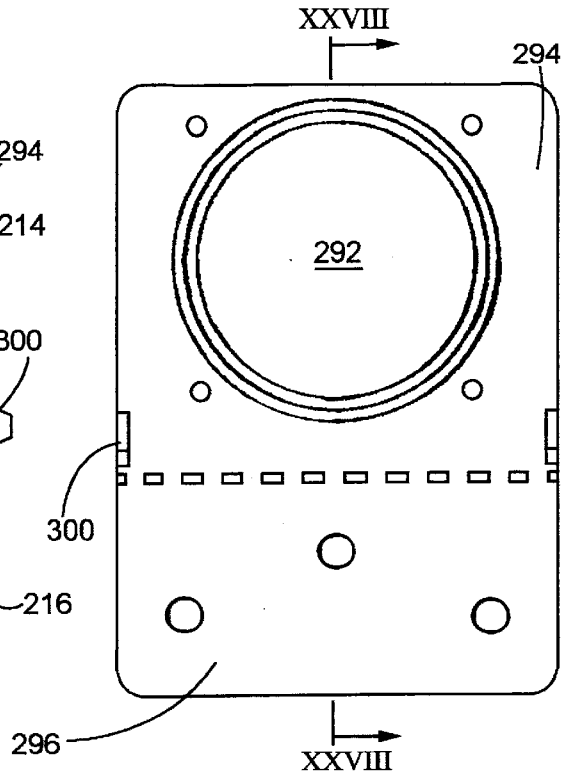
FIG. 26 is a rear view of the rough-in bracket of FIG. 25.
Figure 27:
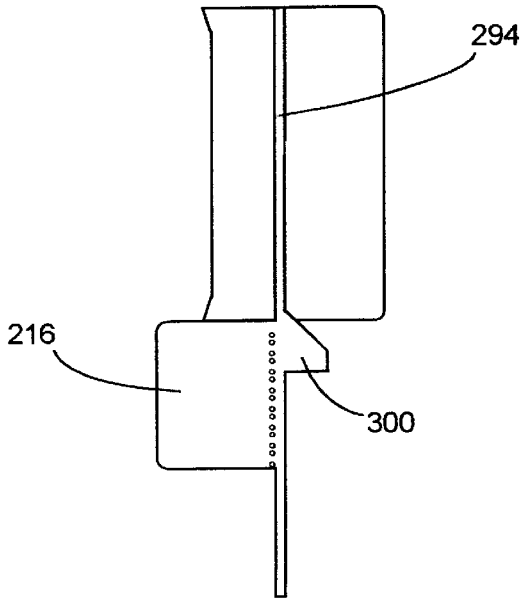
FIG. 27 is a side elevation of the rough-in bracket.
Figure 28:
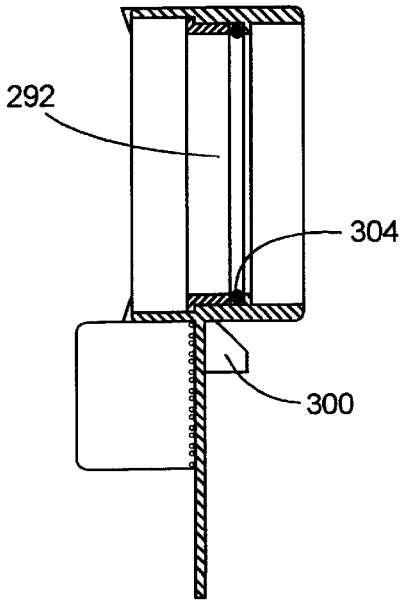
FIG. 28 is a cross sectional view of the rough-in bracket taken along the lines XXVIII—XXVIII of FIG. 26.

Turning now to the rough-in bracket 214 illustrated in FIGS. 25 to 28, this bracket has a relatively large cylindrical hole 292 into which the rearward extension 26 of the inlet device can be inserted in order to mount the inlet apparatus. The bracket also has a radially outwardly projecting flange 294 which is used to position the bracket on the back surface of the drywall. The bracket includes a lower, break-away connecting section 296 which can be provided with fastener receiving holes 298 for screws or nails. The section 296 can be connected to the front surface of the floor plate illustrated in FIG. 1. The section 296 can simply be broken away if it is not required for the location of or positioning of the bracket. Projecting rearwardly from the bracket are two locating tabs or flanges 300 which are used to set the bracket at the correct height as shown in FIG. 1. In other words the bottom edge of the tab should be positioned on the top surface of the floor plate 210 in order to set the bracket at the correct height in the wall. Projecting forwardly from the bracket are two larger locating flanges 216 which can be used to locate the ends of the floor board 302. It will be appreciated that a gap must be formed in the floor board 302 to accommodate the inlet apparatus 10. Positioned in the cylindrical opening of the bracket is an O-ring seal 304 which seals the joint between the bracket and the rearwardly extending pipe section of the inlet apparatus. As shown in FIG. 25, the bracket is formed with four small, threaded fastener receiving holes 306 that surround the aperture 292. These are used to attach the inlet apparatus to the bracket by means of suitable screws (not shown). Two of the screws extend through the two screw holes 308 formed in the base section of the inlet housing (see FIG. 5). One or both of the lower screw holes 306 shown in FIG. 25 may be required if the bracket 214 is rotated 90 degrees and fastened to a wall stud for mounting purposes. This could occur when the floor plate cannot be used.

It is already known to provide a central vacuum inlet (for attaching a vacuum hose) with a built in high voltage line connection. This enables the user of the vacuum system to connect a motorized power-head that is energized when the vacuum hose is inserted into the vacuum inlet. A similar high voltage line connection can be provided in the inlet apparatus of the present invention so that attaching a hose as shown in FIG. 23 will create the required electrical connection to operate a power head.

Figure 29:
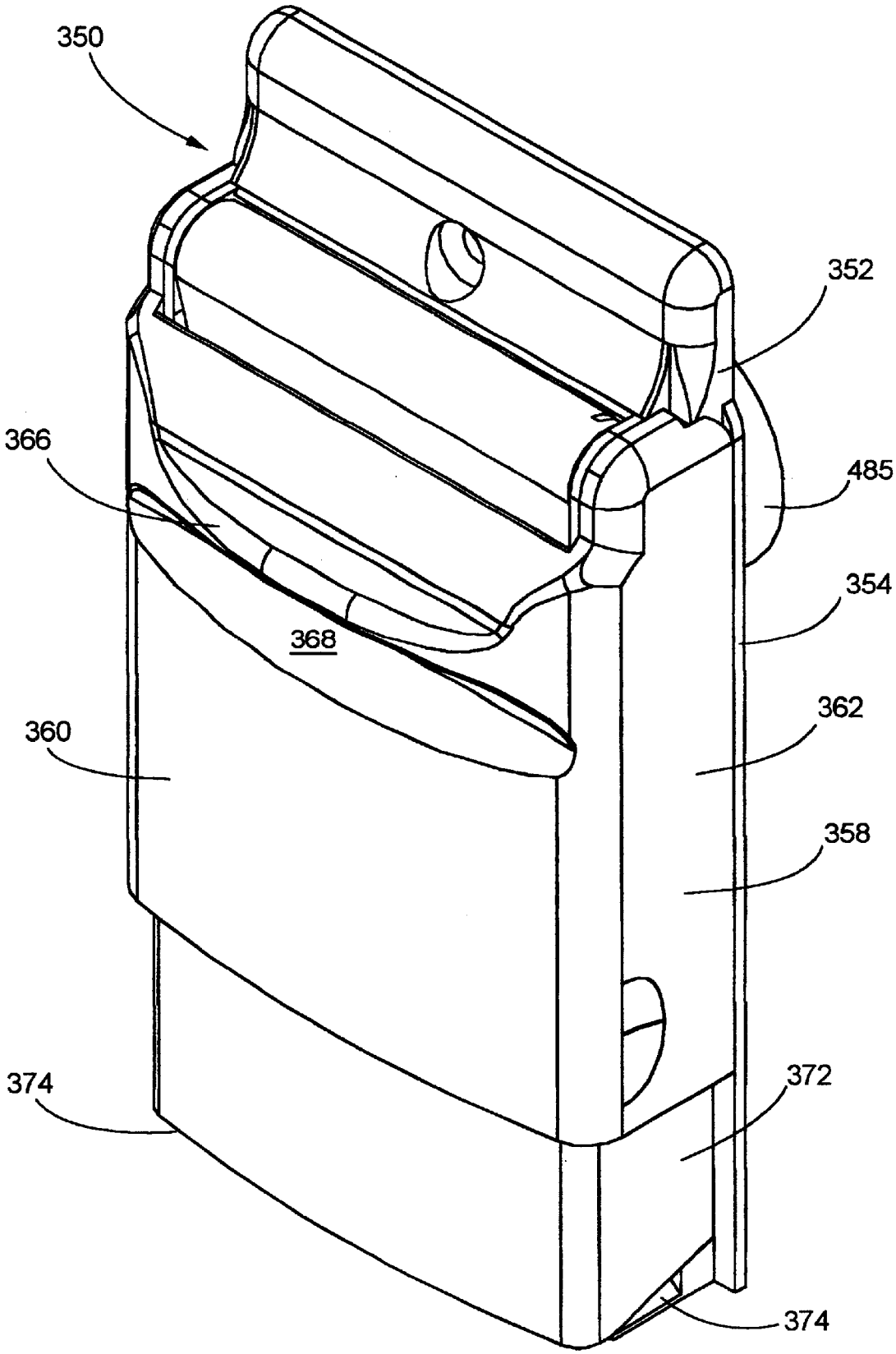
FIG. 29 is a perspective view taken from above and from the right side of a preferred inlet and switching apparatus constructed in accordance with the invention.
Figure 30A:
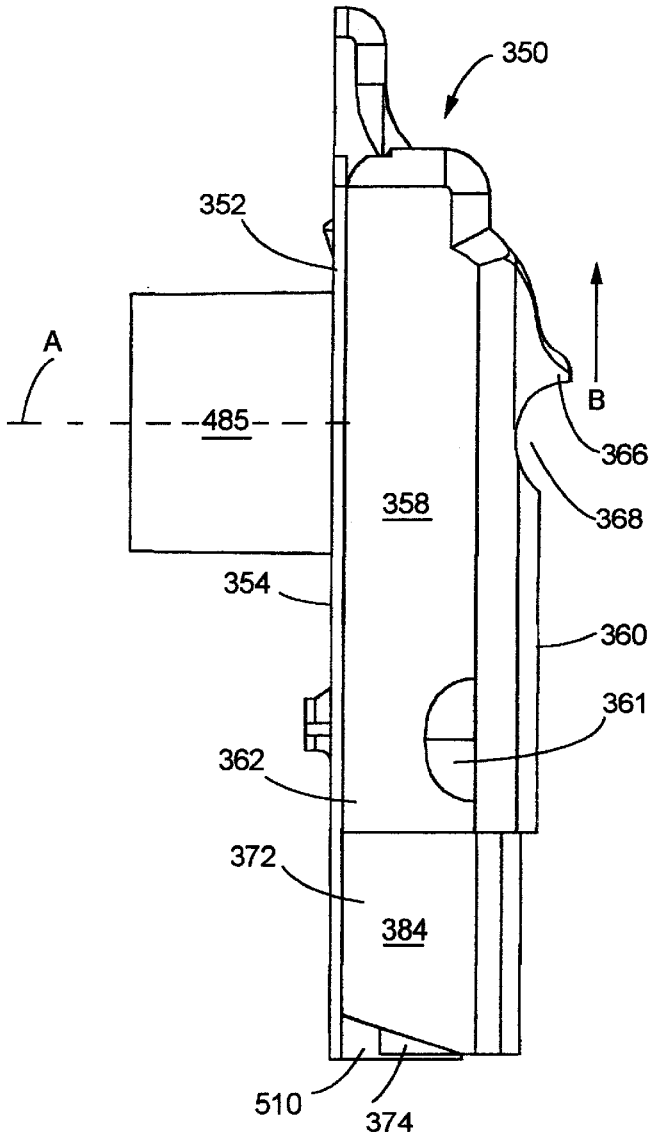
FIG. 30*a* is a left side elevation of the inlet and switching apparatus of FIG. 29, this view showing the apparatus in the OFF position.
Figure 30B:
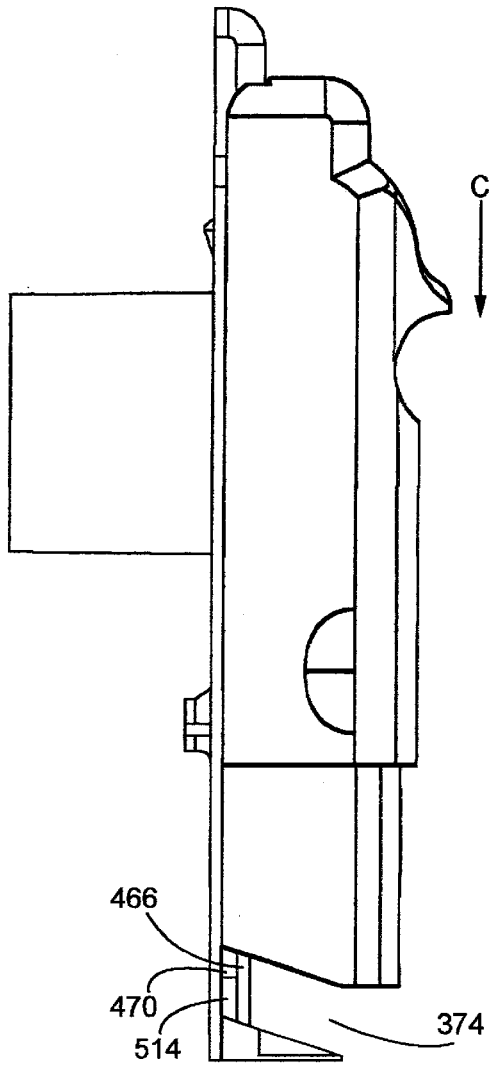
FIG. 30*b* is a left side elevation of the same apparatus but showing the apparatus in the ON position.
Figure 31B:
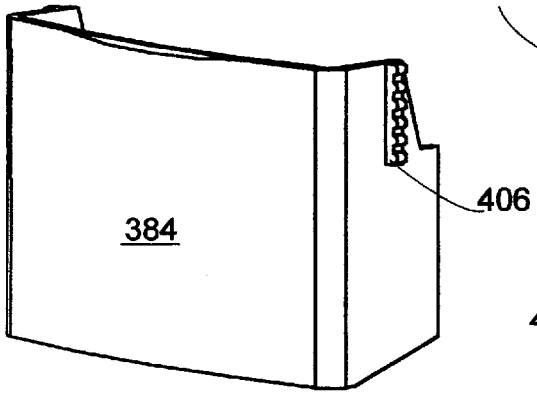
FIG. 31*b* is a perspective view of the inlet extension member used in the apparatus, this view being taken from the front and above.

A preferred form of inlet and switching apparatus for a central vacuum system is illustrated in FIGS. 29 to 31. This preferred apparatus 350 includes a base body section 352 that includes a back wall 354 having an inlet aperture 356 formed therein adapted for connection to a central vacuum source (not shown). The base body section is shown separately in FIG. 32 wherein the inlet aperture 356 can be seen clearly. This preferred base body section 352 is provided with forwardly projecting build-outs or shaped sidewalls 465 to provide directional flow to the center of the aperture 356. This reduces the pinch point in the chamber which thus reduces clogging. Each build-out 465 is preferably formed with a small shoulder at 467 which keeps the flow of air moving over a deflector 477 formed on the closure member 376 (see FIG. 36). The apparatus further includes a cover section 358 preferably slidably mounted on the base body section and extending over a forward side thereof. The cover section 358 includes a front wall 360 that is spaced from and opposite the back wall 354. The preferred cover section further includes two parallel side walls 362 and 364, each of which can be provided with a finger grip 361 if desired. A forwardly projecting lip 366 is preferably formed on the front wall 360 to provide a finger grip for moving the cover section upwardly or downwardly. Also, the cover section 358 can be recessed at 368 to improve the finger grip. It will be understood that the base body section 352 and the cover section 358 together form an inlet housing that, in the preferred embodiment, defines a vacuum inlet chamber 370. The inlet housing has a lower portion 372 which forms a dirt receiving opening 374 that permits dirt to enter the chamber under a vacuum influence. In the standard version of the apparatus 350, the dirt receiving opening 374 is adjacent a horizontal floor surface as in the first embodiment of the apparatus shown in FIG. 1.

Figure 31A:
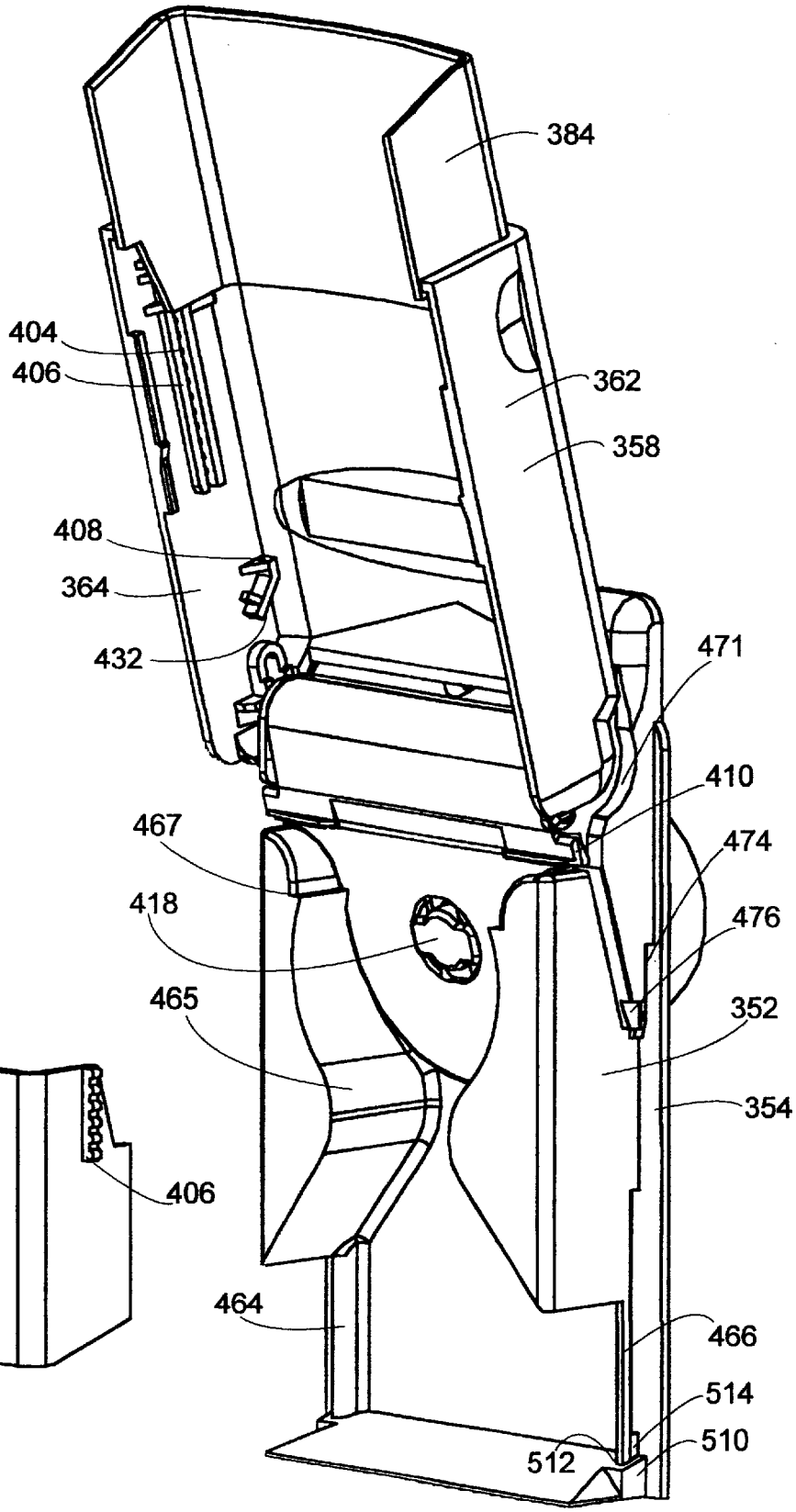
FIG. 31*a* is a perspective view taken from the right side showing a further version of the inlet and switching apparatus with its cover section pivoted to an upper, open position.
Figure 35:
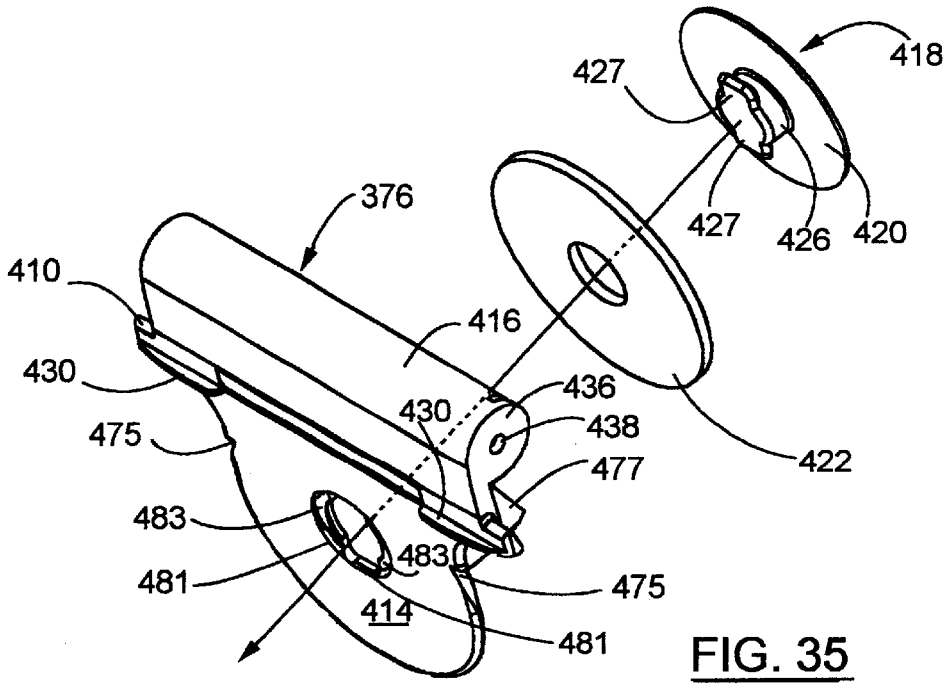
FIG. 35 is a perspective exploded view of the closure or valve member and its seal.
Figure 36:
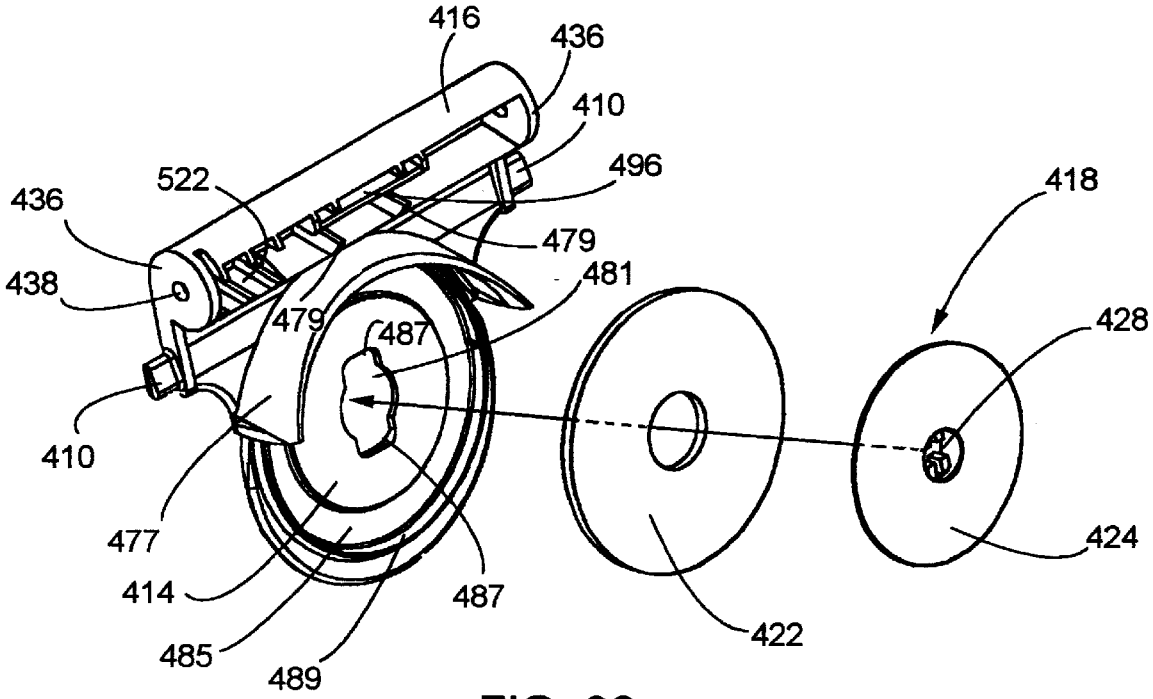
FIG. 36 is a rear perspective exploded view of the closure member of FIG. 35 and its seal.
Figure 39A:
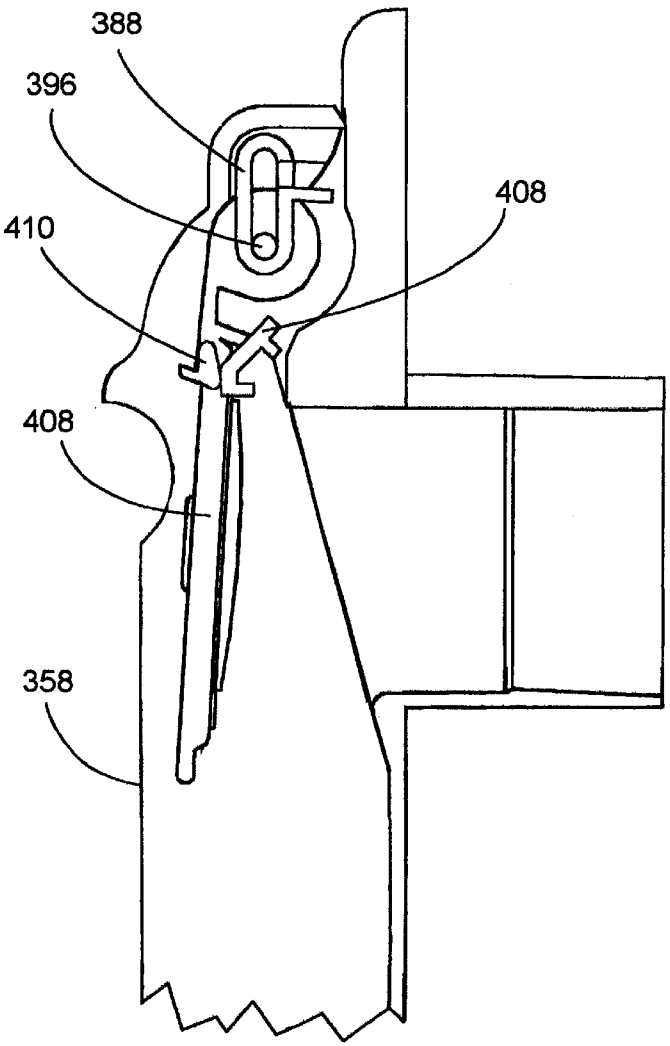
FIG. 39*a* is a schematic elevation similar to FIG. 38 but showing the closure-member in the open position.
Figure 39:
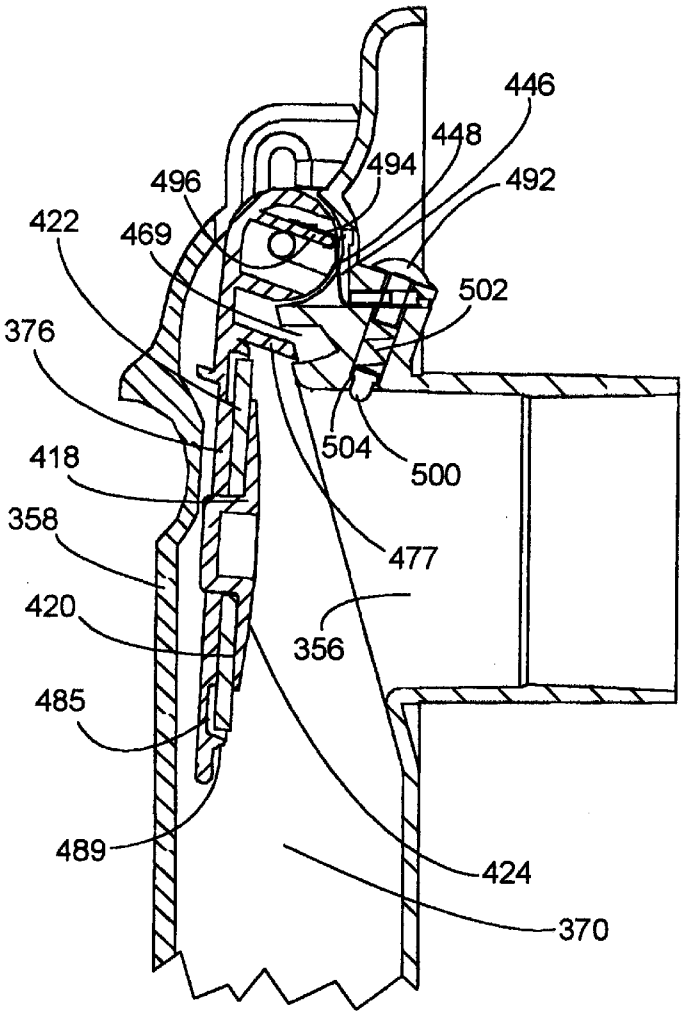
FIG. 39 is a sectional elevation similar to FIG. 37 but showing the closure member pivoted to the open position.

The apparatus 350 also has a closure or valve member 376 which can be seen in the closed position in FIG. 31 a and which is shown by itself in FIGS. 35 and 36. The preferred closure member is pivotably mounted on the base body section 352 but it is also possible to pivotably mount the closure member on the cover section 358, if desired. The closure member 376 is movable between a first position shown in FIGS. 31*a,* 37 and 38 where the inlet aperture is closed by the closure member and a second position where the inlet aperture is open. This second position is illustrated in FIGS. 39 and 39*a* wherein the upper portion of the closure member is shown.

Figure 34:
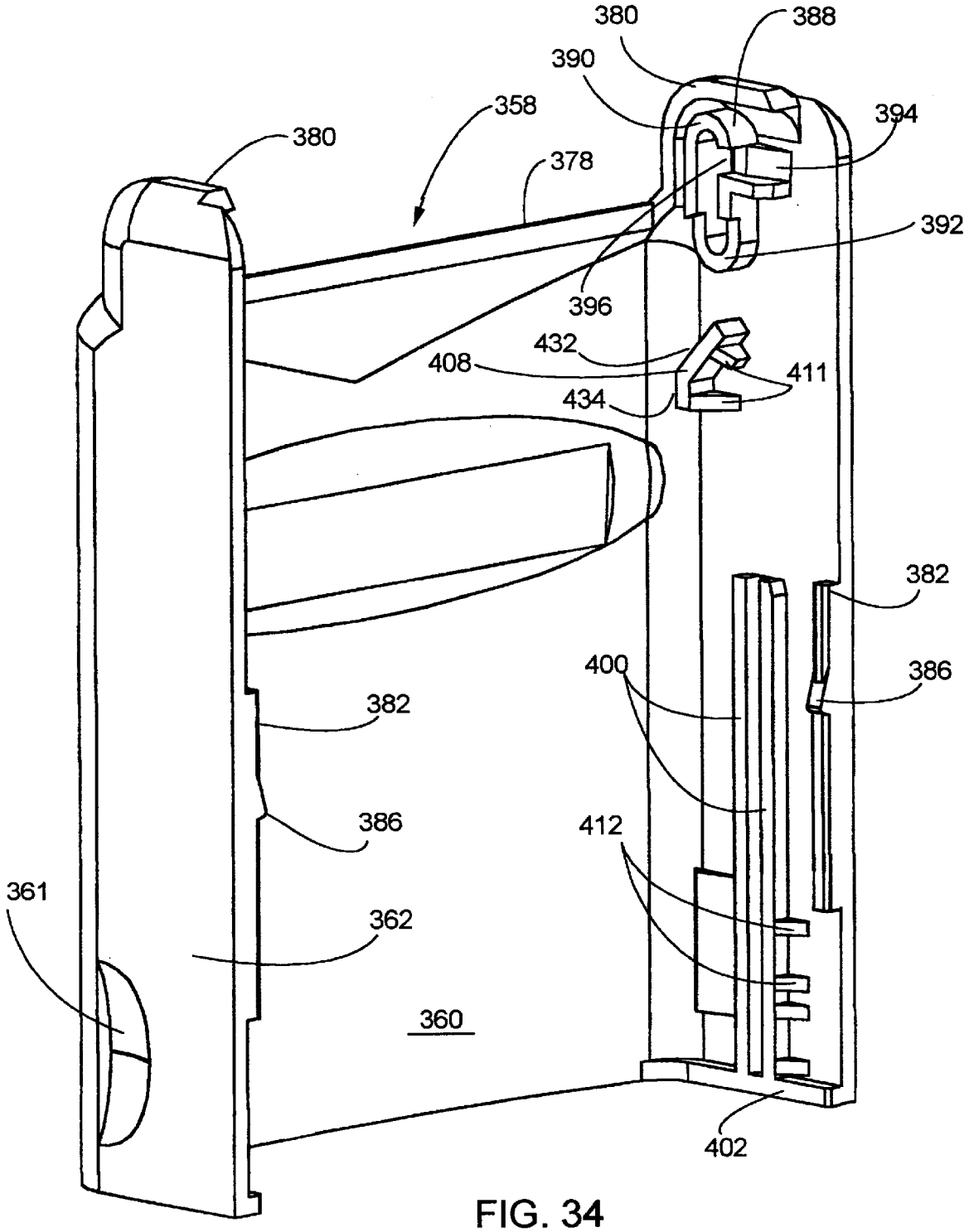
FIG. 34 is a perspective view of the preferred cover section for the apparatus of FIG. 31*a,* this view being taken from the back and the right side.

The preferred construction of the cover section will now be described with particular reference to FIGS. 31*a* and 34. The cover section 354 is generally channel-shaped with open ends at the top and bottom thereof. The two side walls 362, 364 project upwardly from a top edge 378 of the front wall 360. Curved, inwardly projecting flanges 380 are formed on the upwardly projecting portions of the side walls along the front and top edges thereof. Inwardly projecting, elongate flanges 382 also extend along the two rear edges of the cover section. A tooth or catch 386 projects inwardly from each flange 382 and this provides a catch for holding the cover section in the closed position as explained further below.

Located near the upper end of each side wall is a generally oval-shaped, integral pivot structure 388 with a semi-circular upper end section 390 and a semi-circular bottom end 392. If desired, a short, integral ramp 394 can be formed on the rear side of the pivot structure 388. The purpose of the ramp 394 is to allow a metal or plastic axle or pivot pin 396 (see FIGS. 38 and 39*a*) to be snapped into the pivot structure 388. In the alternative, a slot could be provided centrally in the side of the pivot structure 388 for insertion of the pivot pin therein but the use of the preferred ramp permits the pivot structure to be formed as a complete oval loop, thus reducing the chance that the pivot pin might separate from the front cover section by inadvertently slipping through any slot or opening in the pivot structure 388.

Formed along the inside of each side wall 362, 364 are a pair of vertically extending ribs or guide rails 400 and these extend to a short bottom flange 402 which adds rigidity to the cover section. Positioned between each pair of ribs is a series of teeth 404 which can be seen in FIG. 31*a*. Positioned between the two ribs 400 and engaging the teeth 404 is a shorter series of teeth 406 formed on the exterior of each side wall of the downward extension 384, these teeth being shown in FIG. 31*b*. By flexing the side walls of the extension 384 inwardly, the two adjacent series of teeth will be disengaged sufficiently to permit the downward extension 304 to be moved upwardly or downwardly as desired. This permits the size of the bottom opening which receives the dirt and debris to be adjusted. The two pairs of ribs 400 also act to guide the upward and downward movement of the extension 384 and help to hold it in its proper position. As shown in FIG. 31*a,* the downward extension 384 extends at least a short distance into the main cover section.

Also formed on the inside of the cover section on each of the side walls is an engagement structure 408 which is provided for engagement of a portion of the closure member 376. The preferred engagement structure is a guide rail mechanism formed on each side wall and located adjacent a respective engagement member 410 formed on the closure member. As explained further below, a sliding movement of the cover section 358 between an OFF position illustrated in FIGS. 37 and 38 and an ON position illustrated in FIGS. 39 and 39*a* causes the closure member 376 to move from the first or closed position to the second or open position. Both the guide rail mechanism 408 and the ribs 400 can be strengthened by means of integral support brackets 411 and 412.

Turning now to the construction of the closure member 376 as illustrated in FIGS. 35 and 36, the main portion of the closure member, which can be made from a rigid, durable plastic material, has a generally rounded lower section 414 and a partially cylindrical upper section 416 which can be open on a rear side. A gasket member 422 helps to seal the joint between the closure member 376 and the front of the inlet aperture. Other forms of seals or gaskets for the purpose of sealing this joint are of course possible including O-ring type seals, sleevelike seals, etc. and these seals can be mounted either on the lower portion 414 or on the front of the inlet aperture 356.

The gasket member 422 has a central hole and is mounted on the closure member by means of retainer disk 418 that is arranged to compress the gasket as well as hold it in place. The disk 418 has a central boss 426 formed thereon, this boss extending to a flat connecting end at 427. At the end 427 there are two radially projecting connecting flanges on opposite sides of the boss. To mount the gasket member, the boss is inserted through the hole in the gasket and the hole in the closure member 376 with the connecting flanges passing through recessed sections 487. The disk 418 is then turned 90° to engage the connecting flanges with the arc-shaped engagement surfaces at 483. This mounting procedure compresses the gasket in addition to locking it in place. On the rear side of the disk 418 is a slotted structure 428 that allows a worker to use a tool such as a screwdriver to turn the disk 418 when the gasket is in place and compressed. The rear surface 424 of the disk 418 is preferably slightly domed or sloped to maximize airflow. The surface 485 on the rear of the closure member is depressed to allow the gasket some flexibility in order to maximize its sealing ability and to conform to the surface of the base body section 352 in the sealed position. Around this surface 485 is a sloped ridge 489 that protects the outer edge of the gasket as shown more clearly in FIG. 39.

Shown in FIG. 36 is the arc-shaped deflector 477 integrally formed on the back of the closure member 376. This deflector is provided so as to direct all incoming debris through the aperture when the inlet apparatus is in the sweep mode (as is illustrated in FIG. 39). Two indentations 475 are provided in opposite edges of the closure member in order to prevent interference between the closure member and the shoulders 467 on the build-outs 465.

Figure 38:
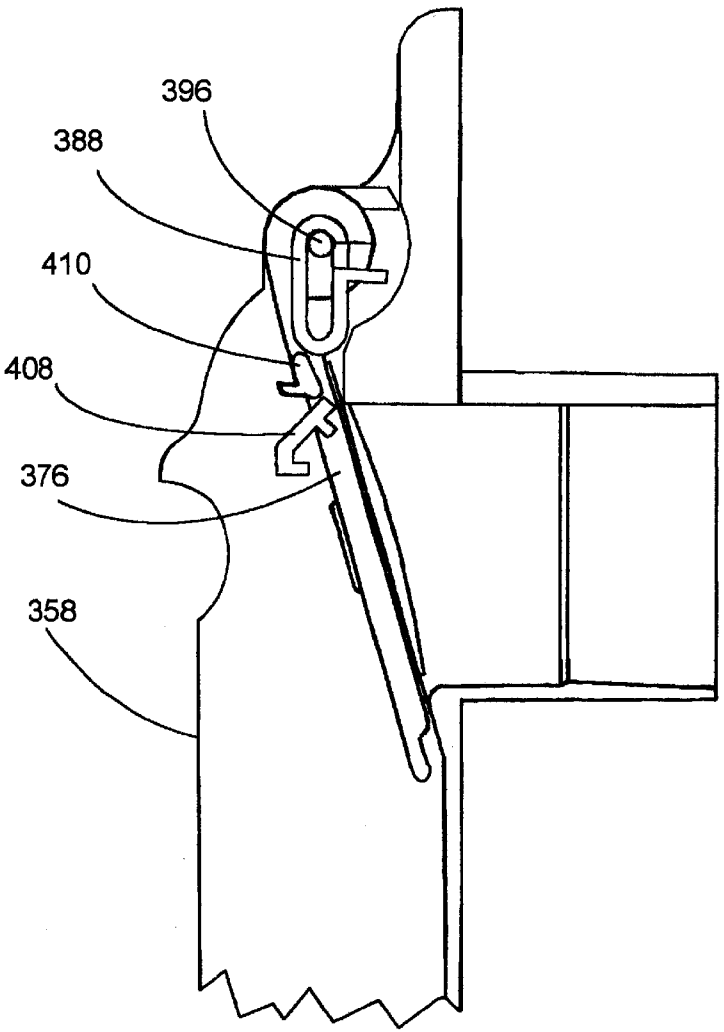
FIG. 38 is a schematic elevation showing the relationship between the front cover, the activation rails and the valve or closure member.

The aforementioned engagement members 410 are positioned at the top of the lower portion 414 and can be strengthened and stiffened by a rail 430 on each side. These rails are integrally formed on the front of the closure member. When the cover section is in its lowermost position, the integral guide rail mechanism 408 formed on each side of the cover section will also be in its lowermost position. In this position, the two engagement members 410 will be positioned above the upper sloping section 432 of the engagement structure (assuming that the cover section has not been pivoted upwardly to the position shown in FIG. 31*a*). Then, an upward sliding movement of the cover section in the direction of the arrow B (see FIG. 30*a*) will cause the section 432 to engage its respective engagement member 410, forcing it and the closure member to pivot forwardly until each engagement member 410 is adjacent the vertical portion 434. The closure member will then be in the open position shown in FIGS. 39 and 39*a*. The amount of the vertical sliding movement of the cover section is of course limited by the interior length of the pivot structure 388. The upper portion 416 of the closure member has circular end walls 436 in the centre of which is a pivot pin hole 438. A downward sliding movement of the cover section in the direction of the arrow C (see FIG. 30*b*) will cause the closure member to move to its closed or OFF position, which is shown in FIG. 38.

Figure 32:
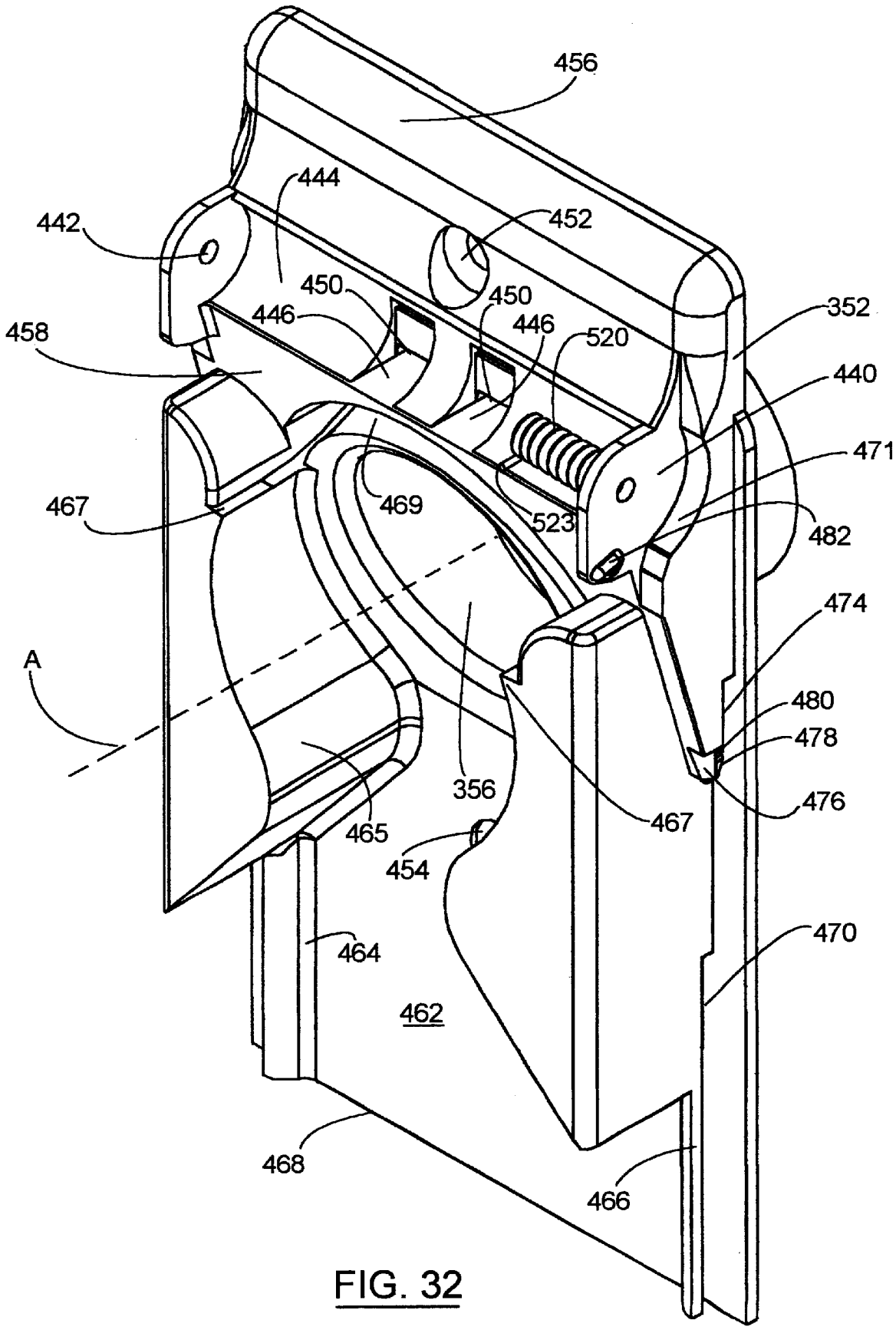
FIG. 32 is a further perspective view taken from above and from the front of a base body section of the apparatus of FIG. 31*a;*
Figure 33:
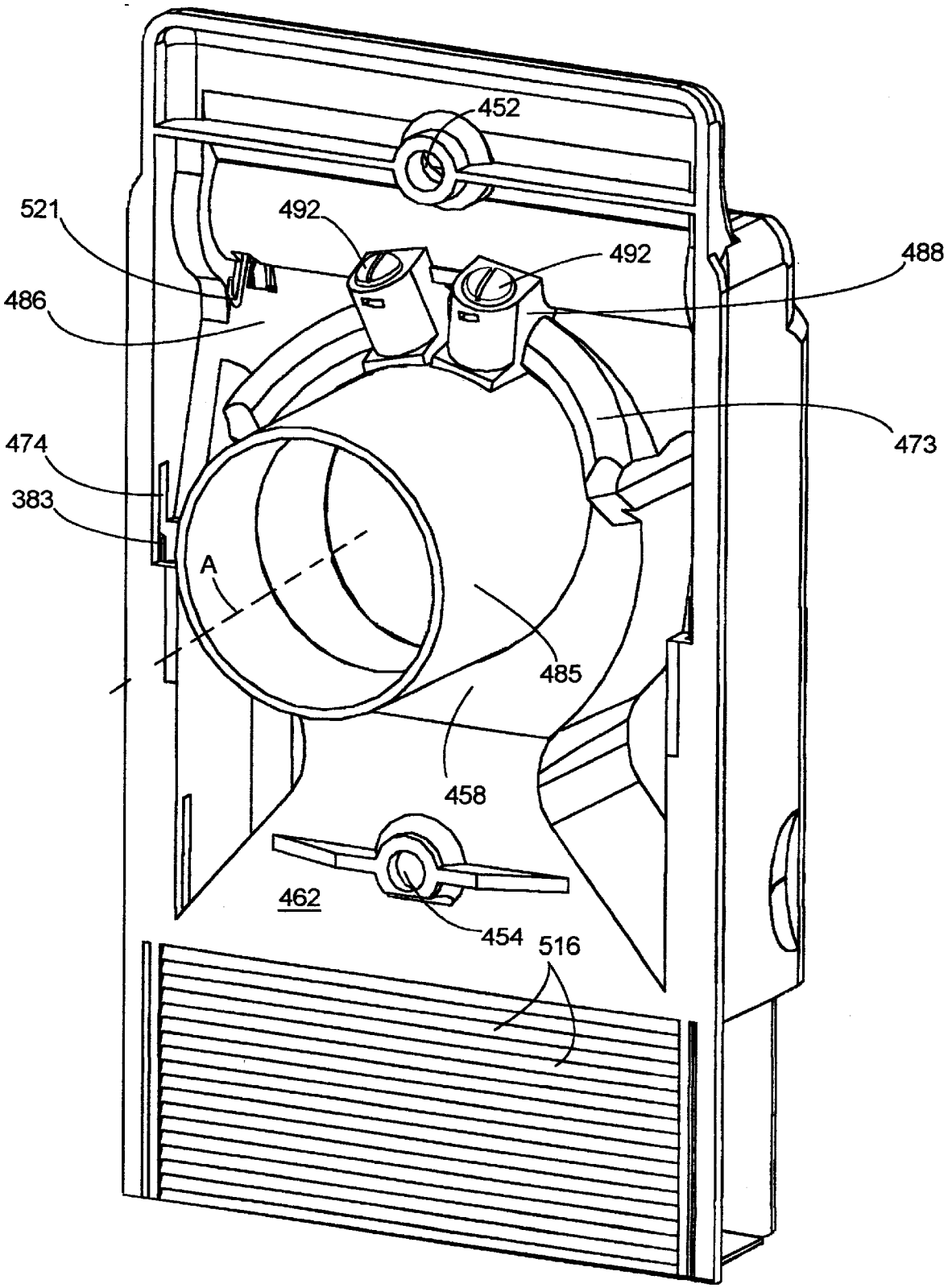
FIG. 33 is a perspective view of the preferred inlet and switching apparatus, this view being taken from the rear and from the left side.

Turning now to the base body section 352, the preferred form of this section is illustrated in detail in FIGS. 32 and 33. With reference to the front side shown in FIG. 32, there are two forwardly projecting axle supports 440 positioned on opposite sides thereof. Each support has a pivot pin hole 442 formed therein. There is a concave wall 444 in the form of a partial cylinder extending between the supports 440 and the upper portion 416 of the closure member is free to pivot along this concave wall. There are two cut-outs or recesses 446 formed in the center region of the concave wall 444 and these are used to accommodate two brush or spring electrical contacts 448, one of which can be seen in FIGS. 37 and 39. These brush contacts extend rearwardly through two holes or slots 450. Also, upper and lower screw holes are provided at 452 and 454. The upper portion of the back wall at 456 can project forwardly and be curved as shown to present a pleasing appearance and to increase rigidity of the structure. Below the concave wall 444, the back wall of the base body section has a sloping section 458 and, in this section, the inlet aperture is formed. This inlet aperture has a central axis A—A. In the sloping section 458 there is depression 469 made to receive the deflector fin 477 located on the back of the closure member 376. FIG. 39 illustrates how this deflector sits in the depression 469 when the inlet apparatus is in the sweep mode. A lower portion 462 of the back wall is substantially vertical and located along this portion near opposite vertical edges are two straight, integral ribs 464 and 466 which extend to the bottom edge 468 of the back wall. Formed on an outer side of each of these ribs is an elongate recess or groove 470 which (as explained below) can be used to attach a ramp. Located on opposite sides of the base body section are two sloping surfaces 476. Each sloping surface 476 engages a top portion of a respective flange 382, which is able to snap over the top of the sloping surface. With the top portion engaged in the groove behind the sloping surface, the cover is held in the closed position. Located adjacent the two surfaces 476 are vertical slots 474 in which the upper portions of the flanges 382 ride when the front cover is slid upwardly on the ON position. As soon as the front cover starts to slide upwardly, the top portion of each flange 328 is held in the groove or slot 474, thereby preventing the front cover from rotating to the open position shown in FIG. 31*a*. This prevents potential binding around the axle that may occur if the front cover is inadvertently rotated by a user attempting to slide the cover vertically. There is also a small ramp 478 which can be formed behind the nub 474 and which can have a downwardly and inwardly sloping surface. The purpose of this ramp is both to hold the cover section 358 in the upper (or ON) position when it is moved upwardly by the user in order to operate the apparatus and also to hold the cover in the lower (or OFF) position. Upward movement of the cover section will cause the tooth 386 to move up the ramp 478 and then to snap inwardly so that the bottom surface of the tooth engages the top 480 of the ramp. Also shown in FIG. 32 is a small nub 482 formed on the outer surface of each axle support 440. The purpose of this nub is to engage and hold the cover section 354 up when it is swung upwardly to expose the closure member. The base body section preferably has a curved shoulder section 471 on each side to keep the front cover in the proper position as it rotates around the axle and prevent binding.

Figure 37:
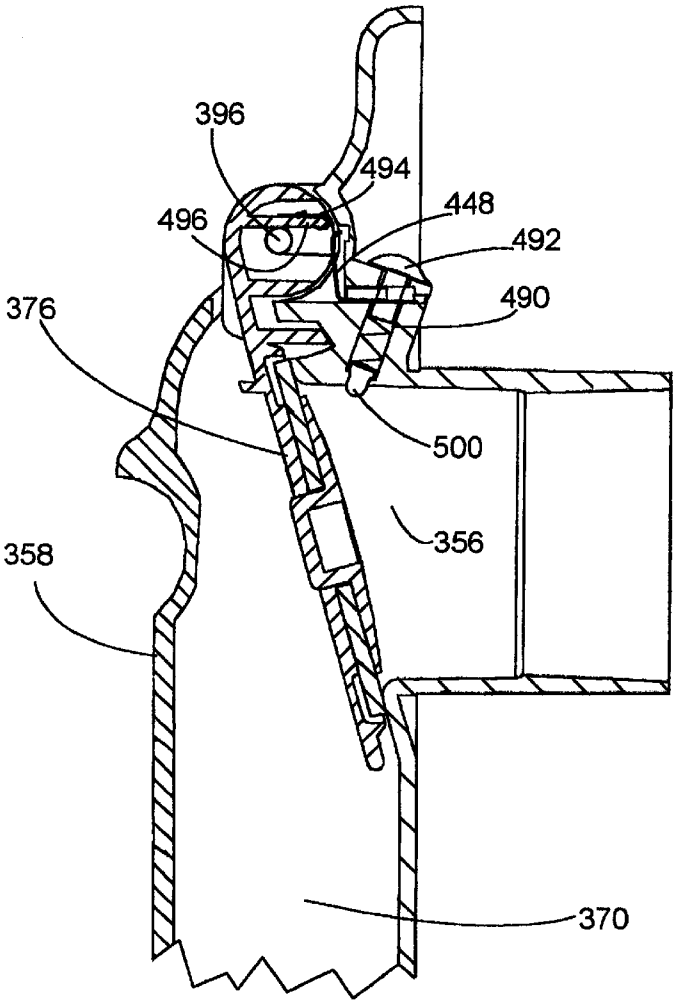
FIG. 37 is a sectional elevation of the upper portion of the apparatus, this view showing the electrical switch mechanism.

Turning now to FIG. 33 which shows the rear of the base body section, it will be seen that the body section has a rearwardly extending tubular extension 485 which is round in cross-section and which is formed around the inlet aperture 356 having the central axis A. This extension is adapted for connection to a rough-in bracket which preferably is the type normally used to mount a standard central vacuum outlet in a wall of a building. Located above the tubular extension 485 and in a recess 486 are two integral protuberances 488 each having a threaded hole for receiving an electrical contact screw 492. Also, in the recess 486 is an arc-shaped back wall 473 forming the back of the depression 469. It will be appreciated that the screws 492 can be used to connect the inlet and switching apparatus 350 to the electrical circuit for the central vacuum system and closure of this electrical circuit at the apparatus 350 will cause the electric motor of the central vacuum system to operate the cleaning system and create a vacuum at the inlet aperture 356. One of the ways of closing the electrical circuit at the apparatus is illustrated in FIGS. 37 to 39*a*. There is a bent metal contact strip 494 mounted on the upper portion of the closure member 376. In particular, it can be mounted on a horizontally extending support member 496 located above the pivot pin 396. A rear end section of the strip 494 can be bent to extend around the edge of the member 496. When the closure member is in the closed position, the contact strip 494 is spaced away from the ends of the brushes 448 as shown in FIG. 37. However, when the closure member is pivoted to the open position as shown in FIGS. 39 and 39*a*, the strip 494 is in contact with both of the brushes 448. thus closing the electrical circuit and causing the central vacuum motor to operate. It will be appreciated that each brush contact 448 has a rearward arm that extends back to and is held by a respective one of the screws 492. Guide rails 479 shown in FIG. 36 prevent the brushes 448 from coming in contact with the strip 494 when the inlet is not in use.

The other way in which the electrical circuit can be closed is also illustrated in FIGS. 37 and 39. In particular, two spaced apart bullets 500, only one of which is shown, project slightly into the tubular rearward extension behind the inlet aperture. Each of these bullets is at the bottom end of one of the holes 490 and each bullet is biased downwardly by a small metal coil spring 502. A captured rim 504 at the top of each bullet prevents the bullet from dropping into the tubular rearward extension. At least the upper end of each coil spring 502 is in electrical contact with its respective screw 492.

Shown in FIG. 33 is a projecting end or leg 521 of a torsion spring 520 used to bias the closure member. A retainer ramp or boss can be provided to hold this leg 521 in a tensioned position and prevent it from sliding back through its hole in the base body section.

As in the first embodiment, a ramp member 510 is preferably provided at the bottom end of the base body section 352. This ramp member can be fitted with slots 512 on opposite sides thereof and the bottom end section of each rib 464, 466 fits into a respective one of these slots as shown in FIG. 31*a*. A small vertical post 514 is provided at the rear of each slot and this post projects into the aforementioned recess 470 to provide additional support for the ramp, which is also called a shoe. The posts 519 also act as a stopper to set either an extension member 526 (see FIG. 40) or an extension member 548 (see FIG. 42) to a proper elevation from the floor. These extension members 526 and 548 are described further hereinafter.

Also as shown in FIG. 33, the lower portion of the back wall or the downward extension thereof has a number of horizontal grooves 516 extending substantially across its width. These grooves facilitate an adjustment to the height of the downward extension of the back wall by permitting the downward extension to be readily cut in order to remove a lower portion thereof before installation of the inlet and switching apparatus 350.

There has been described a preferred inlet and switching apparatus 350 which has a cover section 358 that is not only slidably mounted on the base body section but also pivotably mounted so that the cover section can be pivoted manually from the primary position (which is the position in which the vacuum inlet chamber is formed and which is shown in FIGS. 29 and 30) to an open position which is shown in FIG. 31*a*. In this open position, the closure member or valve member 376 can be pivoted manually to a third or upper position where the inlet aperture is fully exposed, thereby permitting a user to insert a central vacuum hose end directly into the inlet aperture from a forward side thereof. The illustrated cover section can only be pivoted to the open position from its bottommost position, that is the position corresponding to the closed position of the closure member 376 and cannot be pivoted to the open position when the cover section has been moved upwardly to the ON position.

It is also possible to construct the inlet and switching apparatus so that the front cover section is simply removed from the base body section in order to insert the vacuum hose end. This could be accomplished by removal of fastener members or by the use of detachable clip mechanisms integrally formed on the apparatus.

Also, in the preferred embodiment there is a spring mechanism in the form of a coil spring connected to both the closure member 376 and the base body section 352. This spring 520 is shown in FIG. 32 and it will be appreciated that a small hole is formed in the base body section 352 to receive a projecting end of the spring and thereby holding this end of the spring fixedly with respect to the body section. This spring also fits into the hollow cavity formed in the cylindrical upper portion of the closure member, the location of the spring being indicated at 522 in FIG. 36. Again, a projecting end 523 of the spring is held in a suitable slot or hole formed internally within the closure member in order to hold this end of the spring. The engagement structure 408 formed on the cover section acts to override the biasing force of this spring 520 when the cover section is in the ON position, thus holding the closure member 376 in its second or open position. It should be noted that the spring 520 is not required for the illustrated inlet apparatus to work as intended. The preferred inlet apparatus as illustrated is designed so that, provided the front cover is down, the suction of the vacuum will close the valve. As the valve or closure member moves past the contact point that closes the electrical circuit, the valve will snap shut. Also, the suction of the vacuum in the system when another inlet apparatus is used will naturally pull the valve of the unused apparatus to the closed and sealed position, thus ensuring full suction flow to the inlet in use. The use of spring 520 is preferred because it ensures a seal even if the front cover is inadvertently left fully open.

Figure 40:
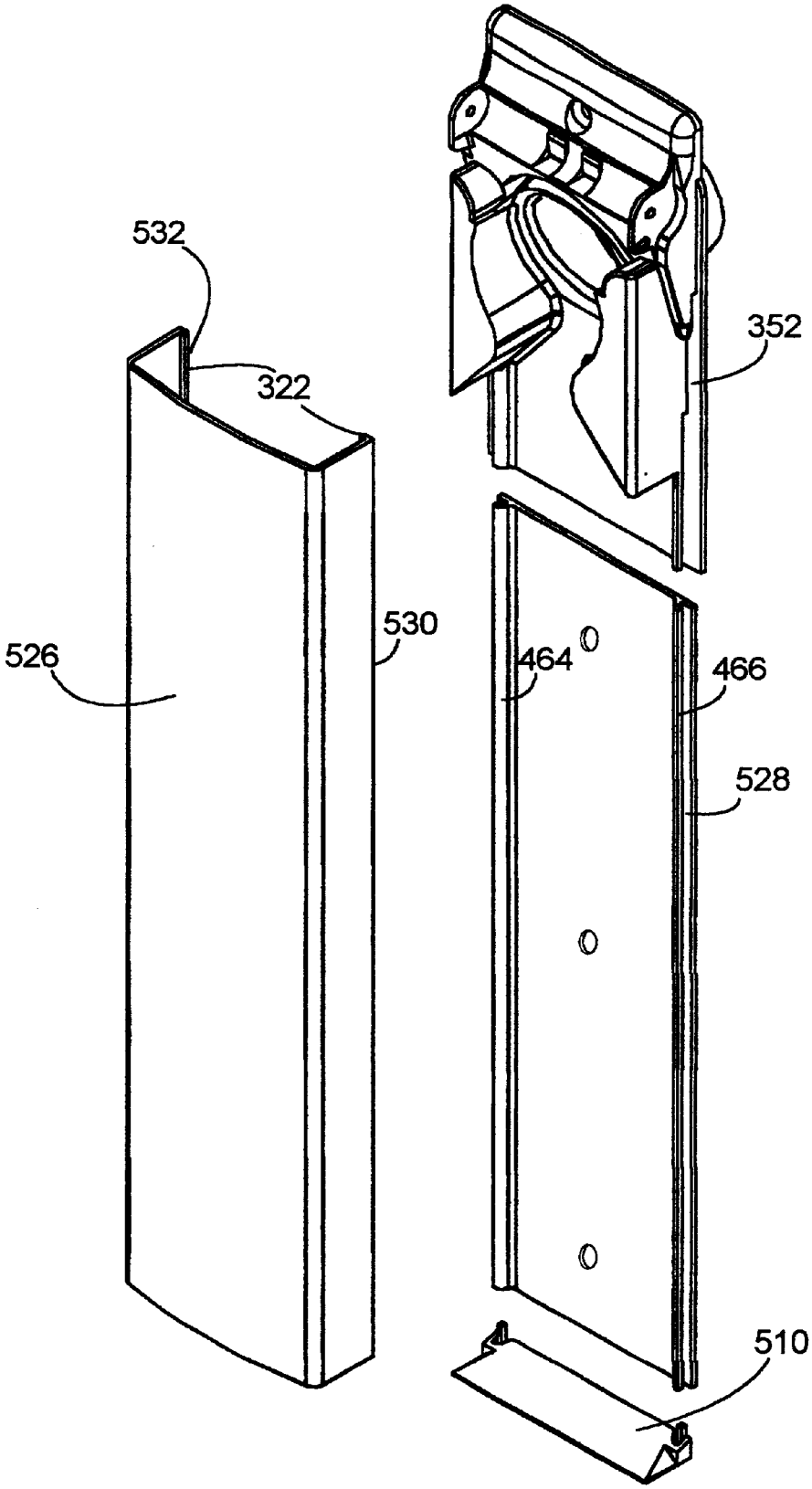
FIG. 40 is a perspective view illustrating the base body section of the apparatus of FIG. 31*a* together with the front and rear portions of a long version of an inlet extension.

FIG. 40 illustrates the use of a relatively long inlet extension that can be used in conjunction with the preferred apparatus 350 having a base body section 352. For ease of illustration, only the base body section 352 is shown in FIG. 40 together with the inlet extension. As in the inlet extension of FIGS. 20, 21 and 24, this long inlet extension includes a relatively long channel-shaped extension member 526 and a generally flat rear extension member 528 adapted for connection to elongate, vertically extending edges 530, 532 of the extension member 526 and also to an exterior surface of the building wall. The use of this long inlet extension permits the apparatus 350 to be mounted at a height similar to or the same as the normal mounting height for a standard central vacuum inlet. Thus, with the use of this long inlet extension, an existing, standard central vacuum inlet can be retrofitted with the apparatus of the present invention and the location of the hole in the building wall need not be changed and indeed it may be possible to use the same mounting bracket to hold and support the apparatus 350. The extension member 526 is designed to project into the open bottom end of the inlet housing (in the same manner as the short downward extension 384 illustrated in FIGS. 30*a* and 30*b*). The extension member 526 is open at upper and lower ends thereof and along a rear side thereof. Short connecting flanges 322 can extend the height of the extension member 526 and project inwardly a short distance. As in the downward extension shown in FIG. 32, the flat extension member 528 can also be provided with elongate, vertical ribs 464 and 466. These ribs help to rigidify and strengthen the flat extension member and also provide a mechanism for attaching the ramp member 510 in the same manner as described above. The preferred long inlet extension has a substantial length of at least six inches, more preferably at least 8 inches, in order to permit the inlet housing to be mounted on a building wall a substantial distance of at least 6 inches, more preferably at least 8 inches, above the horizontal surface to be swept. The long inlet extension can be cut to any desired length by means of a suitable cutting tool such as a saw.

Figure 41:
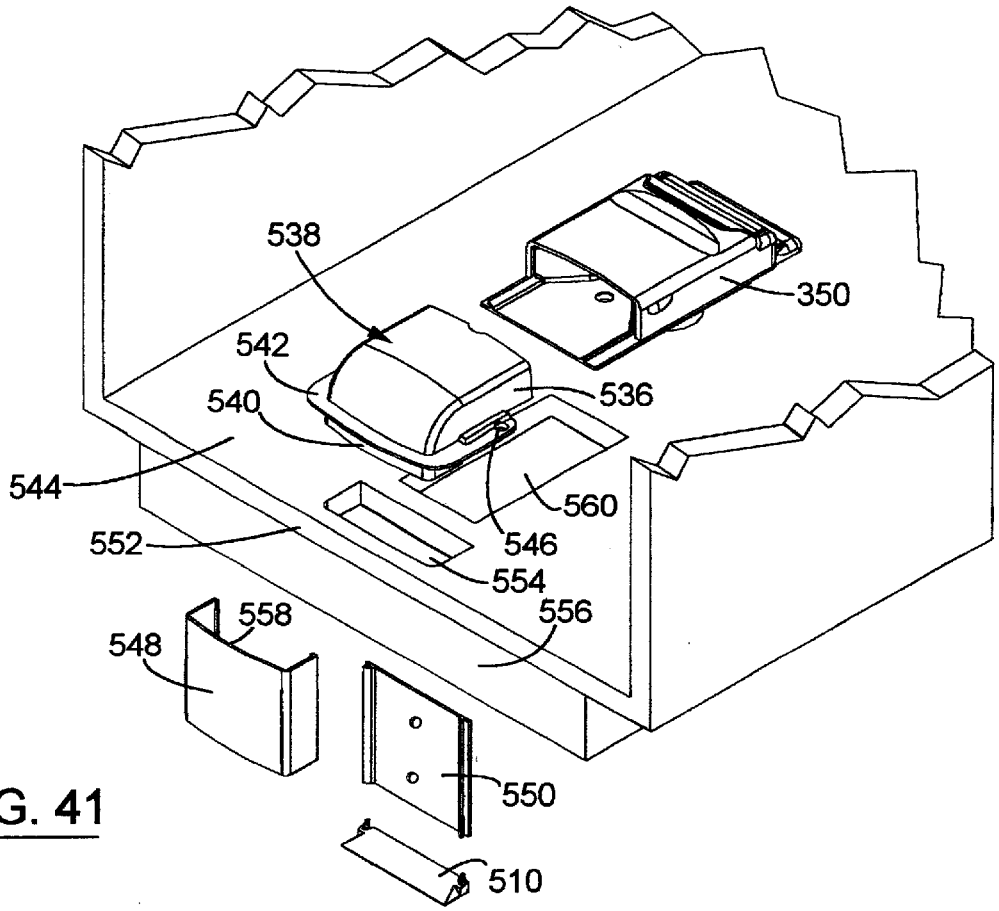
FIG. 41 is a perspective view showing the components (separated from each other) that can be used in combination with the apparatus of FIG. 31*a* to provide this apparatus in a cupboard using an elbow inlet extension.
Figure 42:
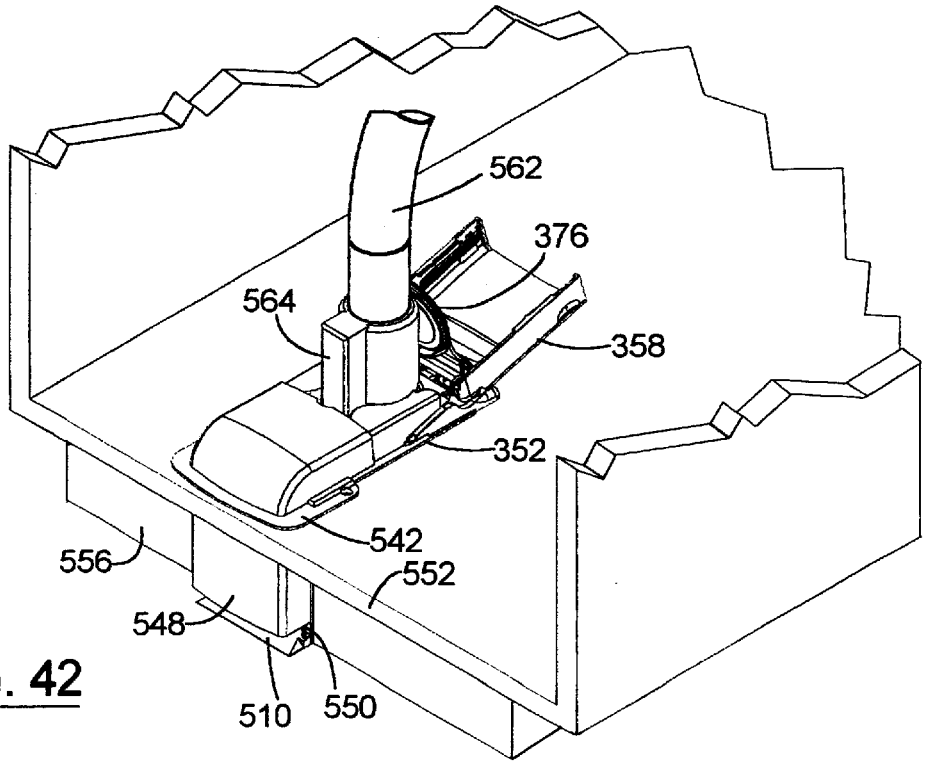
FIG. 42 is another perspective view showing the various components of FIG. 41 connected together and mounted in the bottom of the cupboard.

FIGS. 41 and 42 illustrate how the preferred apparatus 350 can be mounted horizontally in the bottom of a cabinet near a floor surface. In this embodiment, the inlet extension includes an open-ended elbow member 536 which, as shown, has a horizontal leg 538 and a short vertical leg 540. The elbow member has a substantial bend therein whereby the passage in the inlet extension also has a substantial bend therein. As illustrated, this bend is about 90 degrees. The elbow member can be provided with a horizontal mounting flange 542 located at the bend and provided with screwholes 546 on opposite sides thereof. This flange rests against the horizontal surface 544 of the cabinet as shown in FIG. 42. Standard screws can be used to connect the flange to the bottom of the cabinet. The downward leg of the elbow member can be provided with a suitable shoulder (not shown) or a groove extending about its sides in order to secure a straight inlet extension to this end. A short, straight, inlet extension can also be provided with the elbow member and this extension can include a short channel-shaped extension member 548, that detachably connects to the downwardly extending leg of the elbow member and is open at upper and lower ends thereof and along a rear side thereof. The short inlet extension also includes a generally flat rear extension member 550 adapted for connection to the vertically extending rear edges of the channel shaped extension member 548. Except for their length, it will be appreciated that the extension members 548 and 550 can be constructed in the same manner as the channel extension 526 and the flat extension 528 shown in FIG. 40. Again, a ramp 510 can be connected to the bottom end of the rear extension member. The length of the members 548 and 550 can be cut to fit under the projecting edge 552 of the cupboard bottom. A rectangular hole 554 can be cut in the cupboard bottom to snugly receive the downwardly extending leg 540 of the elbow member. After this leg has been inserted through the hole, the extension members 548 and 550 can be attached thereto. In some cases, it may be desirable to attach the flat extension member 550 to the short vertical support wall 556 by means of screws (not shown) prior to extending the elbow member through the hole 554. An upper flange (not shown) can be formed along the upper edge 558 of the extension member 548. This short flange projects inwardly and rests on top of the shoulder (or in a groove on the elbow member) in order to support the extension member 548 in the vertical direction.

A further rectangular opening 560 can be cut in the cupboard bottom for the purpose of mounting the inlet and switching apparatus 350. It will be understood that in the case of the illustrated cupboard, a vacuum pipe of the central vacuum system can be arranged under the bottom 544 of the cupboard and above the adjacent floor, if required. Note that the elbow member 536 does not engage slots in the rails formed on the main inlet body or apparatus 350. There is simply a snug fit between the sides of the horizontal leg 538 and the rails of the main inlet body. Shown in FIG. 42 is an end section of a central vacuum hose 562 that has been inserted into the inlet aperture after the cover section 358 has been swung to the open position and the closure member 376 has been lifted so as to fully expose the inlet aperture. The illustrated hose end is fitted with a high voltage, integral power plug at 564 which can be of standard construction. FIG. 42 illustrates that it is possible to construct the preferred apparatus 350 with a high voltage power socket mounted in the base body section 352 into which the prongs on the plug 564 can be inserted in order to provide high voltage power, ie. 120 volts, to drive a power sweeping head mounted at the outer end of the hose 562. The provision of a high voltage socket of this type is known in standard central vacuum inlets and accordingly a detailed description of such a socket herein is deemed unnecessary.

Figure 43:
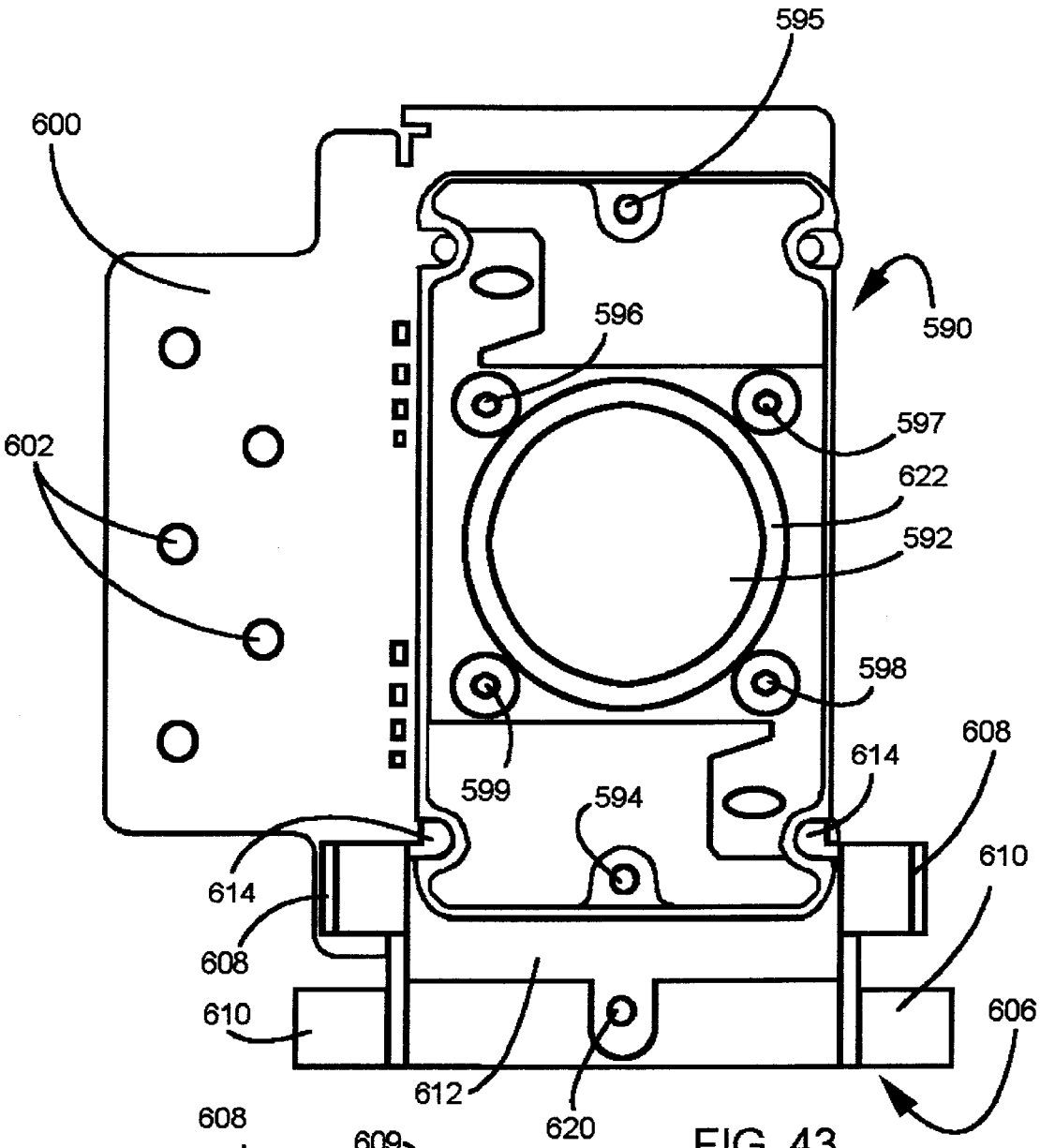
FIG. 43 is a front view of a standard wall bracket for a central vacuum inlet fitted with a base stopper.

Illustrated in FIG. 43 is a mounting bracket 590 for mounting in a wall of a building so as to extend vertically. This mounting bracket 590 has a relatively large circular hole 592 formed centrally therein to snugly receive the rearwardly extending pipe section 485 of the base body section. This mounting bracket is also provided with one or more fastener receiving holes 594 to 599. These holes can be threaded to receive screws. The upper and lower holes 594 and 595 can be aligned with the holes 454 and 452 of the base body section to permit screws inserted through the holes in the base body section to be threaded into the holes 594, 596 in order to secure the base body section at the desired position on the wall. The preferred mounting bracket shown has a break-away connecting section 600 formed along one side edge, which section can be secured. for example by nails, to an adjacent wall stud. This connecting section also has fastener receiving holes 602 formed therein.

Figure 44:
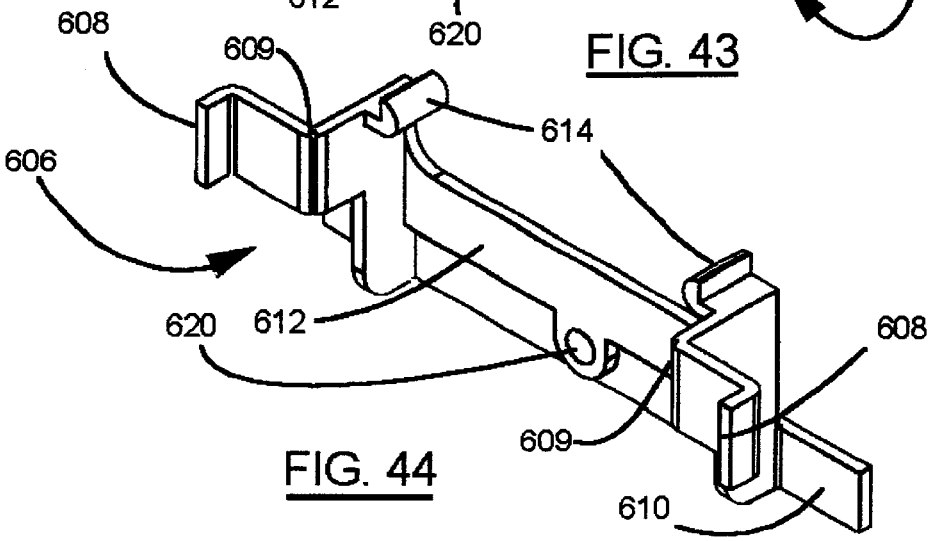
FIG. 44 is a perspective view of the base stopper used with the standard mounting bracket.

The illustrated preferred bracket 590 has a main bracket section that includes the large hole 592 and a lower base stopper 606 detachably connected to a bottom end of the main bracket section, this base stopper being shown separately in FIG. 44. The base stopper is formed with two forwardly projecting L-shaped tabs 608 located on opposite ends thereof for the purpose of locating the correct position of adjacent ends of a baseboard extending along the bottom of the building wall. The tabs 608 can be cut or broken off at respective grooves 609 after installation of the baseboard. Extending upwardly from opposite ends of the base wall are two connecting ridges 614 which are used to connect the base stopper to the main bracket section. The ridges fit into horizontal grooves formed on opposite sides of the main bracket. It will be understood that the stopper would normally only be used when the support bracket is being mounted at the standard, preferred location just above the floor plate, ie. the position shown in FIG. 1. The base stopper is not required if the support bracket is being mounted at an elevated location on the wall, for example, at the usual location for a standard central vacuum inlet. A screw hole 620 can be provided in the base stopper to permit the base stopper to be rigidly connected by a screw to the floor plate of the wall framing, thus stiffening the entire rough-in bracket. The base stopper 606 is preferably formed with two rectangular flanges 610 located at opposite ends thereof. In use, the flanges 610 engage the back side of the drywall and help to clamp the inlet to the drywall surface. In this way the inlet apparatus is prevented from moving by both the clamping action on the flanges and the aforementioned screw extending through the hole 620. After the bracket 590 has been rigidly secured in the wall, the inlet apparatus can then be rigidly mounted on the bracket.

In a known manner, the mounting bracket 590 can be provided with an annular rubber or flexible plastic seal 622 mounted in the large hole 592 in order to seal the joint between the mounting bracket and the rearwardly extending pipe section. This seal can be any one of various known types including an O-ring seal.

It will be appreciated by those skilled in this art that it is also possible to provide a rough-in bracket similar to the bracket 590 but which is provided with an adjustable connection that makes its position adjustable with respect to the vacuum pipe (for example, pipe 200 shown in FIG. 1). Examples of this type of adjustable connection include a slip joint connection or a flexible hose connection. These types of adjustable connections would permit the entire inlet and switching device of the invention to be adjusted up or down by adjusting the position of the rough-in bracket or a portion of it up or down. To explain further, in order to provide this adjusting capability, the fastening flange or connecting section for the bracket can be provided with elongated holes that permit the bracket to be adjusted up or down. In the alternative, there can be a guide rail system in the form of a connecting member having guide rails formed thereon and the main section of the bracket can be slid upwardly or downwardly on these guide rail members and then, when it is in the desired position, secured in this position by tightening a clamping mechanism or by the use of screws etc. By making the rough-in bracket adjustable in this manner, the need for an adjustable lower extension on the front cover may be avoided or lessened.

As will be clear to those skilled in the art, various modifications and changes can be made to the described embodiments without departing from the spirit and scope of this invention. Accordingly, all such modifications and changes are intended to be part of this invention.

I claim:

1. An inlet and switching apparatus for a central vacuum system comprising:

a base body section including a back wall having an inlet aperture adapted for connection to a central vacuum source;

a front body section movably mounted on said base body section and extending over a forward side thereof, said front body section having a front wall, said base body section and said front body section together forming a central vacuum inlet structure capable of forming a vertically extending vacuum passageway leading to said inlet aperture, said inlet structure having a bottom portion adapted to form a dirt receiving opening through which dirt can enter said vacuum passageway, said inlet structure further providing a valve structure movable between a first position where a flow of air and debris through said vacuum passageway and said inlet aperture is prevented and a second position where the air and the debris can flow through said vacuum passageway and out said inlet aperture under a vacuum influence created by said central vacuum system when said inlet aperture is operatively connected to said central vacuum system; and an electrical switch mechanism responsive to the movement of said front body section for actuating said central vacuum source which is turned on and operating when said front body section is moved to an ON position.

wherein a predetermined movement of said front body section between an OFF position and said ON position causes said valve structure to move between said first position and said second position.

2. An inlet and switching apparatus according to claim 1 wherein said front body section is slidable on said base body section between said OFF position and said ON position, said front wall is spaced from and opposite said back wall, and said inlet structure includes a vacuum inlet chamber.

3. An inlet and switching apparatus according to claim 2 wherein said valve structure includes a closure member movable relative to said base body section between said first position where said inlet aperture is closed by said closure member and said second position where said inlet aperture is open at least sufficiently to allow said air and debris to flow through said vacuum passageway.

4. An inlet and switching apparatus according to claim 3 wherein said front body section includes an engagement structure for engaging said closure member so that a sliding movement of said front body section between said OFF position and said ON position causes said closure member to pivot from said first position to said second position.

5. An inlet and switching apparatus according to claim 4 wherein said closure member is pivotably mounted on said body section and has engagement members formed thereon, and said engagement structure comprises a guide rail mechanism formed on said front body section and adjacent said engagement members.

6. An inlet and switching apparatus according to claim 5 wherein said front body section is also pivotably mounted on said base body section so that said front body section can be pivoted from a primary position, in which said vacuum inlet chamber is formed, to an open position where said closure member can be pivoted to a third, uppermost position where said inlet aperture is fully exposed, permitting a user to insert a central vacuum hose end directly into said inlet aperture from a forward side thereof.

7. An inlet and switching apparatus according to claim 4 including a spring mechanism connected to both said closure member and said base body section and biasing said closure member towards said first position, said engagement structure acting to override the biasing force of said spring mechanism when said front body section is in the ON position and to hold said closure member in said second position.

8. An inlet and switching apparatus according to claim 2 wherein said base body section includes a rearwardly extending tubular extension formed around said inlet aperture and adapted for connection to a rough-in bracket mounted in a wall of a building and further includes a pivot member on which said front body section is pivotably mounted, said front body section being pivotable from a primary position in which said vacuum inlet chamber is formed to an open position where a forward side of said inlet aperture is or can be exposed.

9. An inlet and switching apparatus according to claim 1 wherein said inlet structure includes an adjustable downward extension of the front body section, said downward extension having a bottom end which is open and which defines at least t portion of said dirt receiving opening.

10. An inlet and switching apparatus for a central vacuum system comprising:

a base body section including a back wall having an inlet aperture adapted for connection to a central vacuum source;

a front body section movably mounted on said base body section and extending over a forward side thereof, said front body section having a front wall, said base body section and said front body section together forming a central vacuum inlet structure capable of forming a vacuum passageway leading to said inlet aperture, said inlet structure having an end portion adapted to form a dirt receiving opening through which dirt can enter said vacuum passageway, said inlet structure further providing a valve structure movable between a first position where a flow of air and debris through said vacuum passageway and said inlet aperture is prevented and a second position where the air and the debris can flow through said vacuum passageway and out said inlet aperture under a vacuum influence created by said central vacuum system when said inlet aperture is operatively connected to said central vacuum system; and an electrical switch mechanism responsive to movement of said valve structure for actuating said central vacuum source which is turned on and operating by moving said valve structure to said second position, wherein a predetermined movement of said front body section between an initial position and another position causes said valve structure to move between said first position and said second position.

11. An inlet and switching apparatus according to claim 10 wherein said vacuum passageway extends vertically and said dirt receiving opening is located at a bottom end of the inlet structure.

12. An inlet and switching device for a central vacuum system, comprising:

a base body section including a back wall having an inlet aperture formed therein and adapted for connection to a central vacuum source, said inlet aperture being adapted for insertion of a central vacuum hose end;

a front body section mounted on said base body section and extending over a forward side thereof, said front body section having a front wall, said base body section and said front body section together forming a central vacuum inlet structure with a vacuum passageway therein and an end portion thereof forming a dirt receiving opening that opens into said passageway, said vacuum passageway extending at a substantial angle to a central axis of said inlet aperture and said dirt receiving opening being located away from said inlet aperture, said inlet structure further providing a valve structure movable between a closed position where a flow of air and debris through said vacuum passageway is prevented and an open position wherein the air and the debris can flow through said vacuum passageway and out said inlet aperture when vacuum is applied to the inlet aperture; and an electrical switch mechanism mounted on said inlet structure for turning on and causing said central vacuum system to operate, wherein said front body section is mounted on said base body section so that said front body section can be moved from an initial position, in which said inlet aperture is covered thereby, to another position so that said inlet aperture is exposed at least sufficiently to permit a user to insert said central vacuum hose end into said inlet aperture.

13. An inlet and switching device according to claim 12 wherein said front wall is spaced from and located opposite said back wall, said valve structure include a closure member movably mounted on said base body section, and said front body section is movably mounted on said base body section.

14. An inlet and switching device according to claim 13 wherein said closure member is pivotable from said closed position to said open position and to a further position where said closure member is swung away from the inlet aperture in order to expose the inlet aperture for insertion of said central vacuum hose end.

15. An inlet and switching device according to claim 14 wherein said base body section includes screw holes formed therein to permit said base body section to be detachably connected to a rough-in bracket mounted in a building wall and said electrical switch mechanism includes two spaced-apart contacts mounted in an upper section of said base body portion and a metal conductor mounted in a top section of said closure member, whereby movement of said closure member from said closed position to said open position brings said metal conductor into contact with both of said contacts and thereby turns on said central vacuum system.

16. An inlet and switching device according to claim 14 wherein said closure member has a gasket member mounted thereon, said gasket member sealingly engaging said back wall around said inlet aperture when the closure member is in said closed position, and said base body section includes a tubular rearward extension located at said inlet aperture and adapted to receive said central vacuum hose end and to be connected to a pipe of said central vacuum system.

17. An inlet and switching device according to claim 14 wherein said switch mechanism includes two pairs of spaced-apart electrical contacts mounted in an upper section of said base body section, two screw holes are formed in said base body section in the region of all four contacts, two metal screws are mounted in said screw holes and are in contact with both said pairs of electrical contacts, said screws being connectible to an electrical circuit for operating said central vacuum system, a metal conductor is mounted in a top section of said closure member whereby movement of said closure member from said closed position to said open position brings said metal conductor into contact with both contacts of one of said pairs in order to turn on said central vacuum system, and the other pair of contacts project slightly into said inlet aperture so that a gap between the contacts of the other pair can be closed for electrical conductance by insertion of the central vacuum hose end into the inlet aperture.

18. An inlet and switching device according to claim 13 wherein said front body section is pivotably mounted on said base body section so that said front body section can be pivoted from said initial position to said another position.

19. An inlet and switching device according to claim 18 wherein said actuator is an engagement structure formed on said front body section for engaging a portion of said closure member and a sliding movement of said front body section from said initial position to an ON position causes said closure member to be pivoted from said closed position to said open position.

20. An inlet and switching device according to claim 19 herein said base body section includes a pivot member forming a horizontal pivot axis for each of said front body section and said closure member, said engagement structure comprises two rails integrally formed on opposite sidewalls of said front body section, and said two rails slidingly engage two projections formed on opposite sides of said closure member in order to pivot said closure member from said closed position to said open position.

21. An inlet and switching device according to claim 13 wherein said front body section includes an actuator for pivoting said closure member from said closed position to said open position.

22. An inlet and switching device according to claim 21 wherein said actuator is a lever connected to said closure member and manually operable from outside said inlet structure.

23. An inlet and switching device according to claim 13 wherein two electrical contacts project slightly into said inlet aperture, a gap formed between said contacts can be closed for electrical conduction by said insertion of said central vacuum hose end, and said base body section includes electrical connectors for connecting an electrical circuit for operating said central vacuum system to said two contacts.

24. An inlet and switching device according to claim 12 wherein said front body section has an adjustable downward extension forming said end portion and having a bottom end which is open.

25. An inlet and switching apparatus for a central vacuum system comprising:

an inlet housing forming a vacuum inlet chamber having a debris receiving bottom opening, and having a back wall with an inlet aperture, said inlet aperture configured for connection to a suction-providing pipe of the central vacuum system, said inlet housing being adapted for mounting to a fixed supporting structure;

a valve device movably mounted in or on said inlet housing for selectively opening and closing said inlet aperture to the passage of air therethrough during operation of the central vacuum system, said inlet housing including a valve operating member for selectively operating the valve device to open and close the inlet aperture;

an electrical switch for activating and de-activating a vacuum cleaner motor of said central vacuum system; and a downwardly extending inlet extension adjustably connected to said inlet housing and forming a passageway for debris to flow upwards into said vacuum inlet chamber through said bottom opening, wherein a debris-receiving opening is provided at a bottom end of said downward extension and is adapted for positioning adjacent a horizontal surface to be swept.

26. An inlet and switching apparatus according to claim 25 including a support bracket adapted for mounting vertically on said supporting structure, which comprises a wall of a building, and having an opening for receiving a tubular rearward extension of said inlet aperture, wherein screw holes are formed in both the back wall of said inlet housing and said bracket for rigid attachment of said inlet housing to said support bracket.

27. An inlet and switching apparatus according to claim 26 wherein said support bracket comprises a main bracket section and a lower base stopper detachably connectible to a bottom end of said main bracket section, said main bracket section having said opening for the tubular rearward extension formed therein and said base stopper being formed with forwardly projecting tabs on opposite ends thereof for locating a correct position of adjacent ends of a baseboard extending along the building wall.

28. An inlet and switching apparatus according to claim 25 wherein said inlet extension includes a channel-shaped extension member which projects into a bottom end of said inlet housing and is open at upper and lower ends thereof and along a rear side thereof.

29. An inlet and switching apparatus according to claim 28 wherein said back wall of said inlet housing includes a downward extension that is generally planar and has a height selected so that, after installation of said apparatus on said supporting structure, a bottom edge of said downward extension is located close to or at said horizontal surface to be swept while said inlet aperture is located at least a short distance above a horizontal floor plate of said supporting structure, and wherein rear edges of said extension member extend along and contact said downward extension of said back wall in order to form said passageway for debris to flow upwards from said horizontal surface.

30. An inlet and switching apparatus according to claim 29 including a detachable ramp member connected to said bottom edge of the downward extension and projecting forwardly therefrom.

31. An inlet and switching apparatus according to claim 30 wherein the downward extension of said back wall has a number of horizontal grooves extending substantially across its width, said grooves facilitating an adjustment to the height of said downward extension by permitting said downward extension to be cut in order to remove a lower portion thereof before installation of the inlet and switching apparatus.

32. An inlet and switching apparatus according to claim 25 wherein said inlet extension has a substantial length of at least 6 inches in order to permit said inlet housing to be mounted on a building wall, which provides said supporting structure, a substantial distance of at least 6 inches above the horizontal surface to be swept.

33. An inlet and switching apparatus according to claim 32 wherein said inlet extension includes a channel-shaped extension member which projects into a bottom e nd of said inlet housing and is open at upper and lower ends thereof and along a rear side thereof and a generally flat rear extension member adapted for connection to elongate, vertically extending edges of the channel-shape extension member and to an exterior surface of said building wall.

34. An inlet and switching apparatus according to claim 25 including a support bracket for mounting horizontally on said supporting structure, which comprises a horizontal surface of a cabinet or counter and having an opening for receiving a tubular extension of said inlet aperture, wherein fastener holes are formed in both the back wall of said inlet housing and the bracket for rigid attachment of said inlet housing to the support bracket.

35. An inlet and switching apparatus for a central vacuum system comprising:

a central vacuum inlet structure for mounting on a rigid support, said inlet structure including a back wall having an inlet aperture adapted for connection to a central vacuum source and a front wall extending over a forward side of said back wall, said inlet structure capable of forming a vertically extending vacuum passageway leading to said inlet aperture, said inlet structure having a bottom portion adapted to form dirt receiving opening through which dirt can enter said vacuum passageway and also providing a valve structure movable between a first position where a flow of air and debris through said vacuum passageway and said inlet aperture is prevented and a second position where air and debris can flow through said vacuum passageway and out said inlet aperture under a vacuum influence when said apparatus is connected to the central vacuum system and the latter is turned on; and an electrical switch for activating and de-activating a vacuum cleaner motor of said central vacuum system, wherein said inlet structure includes a downwardly extending inlet extension adjustably connected to an upper portion of said inlet structure and forming part of said vacuum passageway and said dirt receiving opening, a bottom end of said inlet extension being movable for positioning adjacent a horizontal surface to be swept.

36. An inlet and switching apparatus for a vacuum cleaning system comprising:

a vacuum inlet structure for mounting on a rigid support, said inlet structure including a rear wall having an inlet aperture adapted for connection to a vacuum source and a front wall extending over a forward side of said rear wall, said inlet structure capable of forming a first vacuum passageway leading to said inlet aperture, said inlet structure having an end portion forming a first opening through which dirt can enter said first vacuum passageway and also providing a valve structure movable between a first position where a flow of air and debris through said vacuum passageway and said inlet aperture is prevented and a second position where air and debris can flow through said vacuum passageway and out said inlet aperture under a vacuum influence when said apparatus is connected to the vacuum cleaning system and the latter is turned on;

an electrical switch for activating and de-activating a vacuum cleaner motor of the vacuum cleaning system; and a relatively rigid inlet extension adjustably connected to said inlet structure and forming a further passageway for dirt and debris to flow into said first passageway through said first opening, wherein a second opening for receiving debris is provided at an outer end of the inlet extension remote from said inlet structure and can be positioned adjacent a surface to be cleaned.

37. An inlet and switching device according to claim 36 wherein said inlet extension includes an open-ended elbow member having a substantial bend therein whereby said further passageway in the inlet extension also has a substantial bend therein.

38. An inlet and switching device according to claim 37 wherein said inlet extension further includes a channel-shaped extension member, that detachably connects to a downwardly extending leg of said elbow member and is open at upper and lower ends thereof and along a rear side thereof, and a generally flat rear extension member adapted for connection to vertically extending rear edges of the channel-shaped extension member.

39. An inlet and switching device according to claim 36 wherein said valve structure includes a valve member movably mounted in said inlet structure for selectively opening or closing said inlet aperture to the passage of air and debris therethrough, said inlet structure including a valve operating member for moving said valve member to open or close the inlet aperture, and wherein said valve operating member is a slidable front cover of the inlet structure which engages projections formed on said valve member in order to move the valve member and said electrical switch is responsive to sliding movement of said front cover for activating and de-activating the vacuum cleaner motor.

40. An inlet and switching apparatus for a central vacuum system said apparatus being suitable for mounting on a wall of a building and comprising:

a base body section including a back wall having a debris-removing aperture formed therein and a rearwardly extending pipe section rigidly connected to said back wall at said aperture, said pipe section being connectible to a suction providing pipe of said central vacuum system;

a cover section mountable on said base body section and extending over a forward side thereof, said base body section and said cover section together forming an inlet housing defining a vacuum inlet chamber and having a dirt receiving opening at a bottom end thereof;

a valve member movably mounted in said inlet housing for selectively opening and closing said vacuum chamber for passage of air and debris therethrough, said inlet housing including a valve operating member for moving said valve member to open or close the vacuum chamber;

an electrical switch responsive to movement of said valve operating member for activating and de-activating a vacuum cleaner motor of the central vacuum system; and a mounting bracket for mounting in a wall of a building so as to extend vertically and having a relatively large hole formed therein to snugly receive said pipe section and at least one small fastener-receiving hole.

wherein said base body section is connectible to said mounting bracket by means of at least one fastener extending from said base body section into said at least one fastener receiving hole.

41. An inlet and switching apparatus according to claim 40 wherein said cover section is pivotably mounted on said base body section so that said cover section can be pivoted away from said base body section to thereby expose said debris-removing aperture, and wherein said aperture and said pipe section are capable of receiving an end section of a central vacuum hose when said cover section is pivoted away from said base body section.

42. An inlet and switching apparatus according to claim 40 wherein said cover section includes an upper cover section and an inlet extension member adjustably connected to said upper cover section and forming a passageway for flow of debris and dirt into said vacuum inlet chamber, said inlet extension member having a dirt receiving opening at a bottom end thereof.

43. An inlet and switching apparatus according to claim 42 wherein said mounting bracket has an annular seal mounted in said relatively large hole in order to seal the joint between the mounting bracket and said rearwardly extending pipe section.

44. An inlet and switching apparatus according to claim 40 wherein said mounting bracket has a breakaway connecting section formed along one side edge, said connecting section having fastener-receiving holes formed therein, and said mounting bracket also has two locating flanges that project forwardly from positions adjacent opposite, vertically extending edges of the mounting bracket.

45. An inlet apparatus for a central vacuum system comprising:

a tubular body forming an inlet aperture and adapted for connection to a central vacuum source at a location above floor level;

a front section connected to a front end of said tubular body and forming an enclosed chamber through which air and debris can flow during use of said apparatus, front section having a bottom aperture and a rear aperture, the rear aperture permitting said air and debris to flow into said tubular body;

an elongate inlet extension connectible to said front section at said bottom aperture and forming a downwardly extending substantially vertical passageway for air and debris to flow upwards and through said front section during use of said apparatus, said inlet extension having a debris-receiving bottom opening for positioning adjacent said floor level;

wherein the length of said inlet extension is adjustable in order to permit said debris-receiving bottom opening to be positioned adjacent said floor level.

46. An inlet apparatus according to claim 45 wherein said inlet extension has sufficient length to enable said tubular body to be connected to said central vacuum source at a location about one foot above floor level.

47. An inlet apparatus according to claim 46 wherein said inlet extension is connected to said front section by a telescoping connection.

48. An inlet apparatus according to claim 45 wherein said inlet extension has a substantial length of at least 8 inches.

49. An inlet apparatus according to claim 45 wherein said front section is an elbow member and said enclosed chamber forms an airflow passageway with a substantially 90° bend.

50. In an inlet apparatus for a central vacuum system comprising a tubular body forming an inlet aperture and adapted for connection to a central vacuum source at a location above floor level and a front section connected to one end of said tubular body and forming an enclosed air passage through which air and debris can flow during use of said apparatus, said front section having an inlet opening and an outlet opening, the outlet opening permitting said air and debris to flow into said tubular body, the improvement comprising an elongate inlet extension connected to said front section at said inlet opening and forming a downwardly extending, substantially vertical passageway for air and debris to flow upwards and through said front section during use of said inlet apparatus, said inlet extension having a debris-receiving bottom opening that can be positioned adjacent said floor level, and said outlet opening of the front section being positioned at a rear end thereof.

* * * * *